US007447460B2

(12) United States Patent
Tsuchihashi et al.

(10) Patent No.: US 7,447,460 B2
(45) Date of Patent: Nov. 4, 2008

(54) COLOR IMAGE FORMING DEVICE HAVING AN OUTPUT TONER TRANSPORT MEMBER

(75) Inventors: Yoshikane Tsuchihashi, Osaka (JP); Kenichi Tanabe, Aomori (JP); Rumi Nagae, Osaka (JP); Tohru Nakayama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 92 days.

(21) Appl. No.: 11/468,283

(22) Filed: Aug. 29, 2006

(65) Prior Publication Data

US 2007/0201903 A1 Aug. 30, 2007

(30) Foreign Application Priority Data

| | | |
|---|---|---|
| Aug. 31, 2005 | (JP) | 2005-252489 |
| Jul. 31, 2006 | (JP) | 2006-208760 |
| Jul. 31, 2006 | (JP) | 2006-208761 |

(51) Int. Cl.

| | |
|---|---|
| ***G03G 15/00*** | (2006.01) |
| ***G03G 15/01*** | (2006.01) |
| ***G03G 15/08*** | (2006.01) |

(52) U.S. Cl. ..... 399/88; 399/112; 399/258

(58) Field of Classification Search ..... 399/258, 399/88, 119, 120, 112, 262; 222/DIG. 1
See application file for complete search history.

(56) References Cited

U.S. PATENT DOCUMENTS

| | | | | |
|---|---|---|---|---|
| 7,139,516 | B2 * | 11/2006 | Makino | 399/258 |
| 2006/0222413 | A1 * | 10/2006 | Nagae | 399/262 |

FOREIGN PATENT DOCUMENTS

| | | | |
|---|---|---|---|
| JP | 08-054778 A | * | 2/1996 |
| JP | 9-160338 A | | 6/1997 |

* cited by examiner

*Primary Examiner*—Sophia S Chen
(74) *Attorney, Agent, or Firm*—Global IP Counselors, LLP

(57) ABSTRACT

A color printer includes a color printer main body, a photosensitive drum, a rotary development device, a plurality of toner containers and a drive power transmission mechanism. The drive power transmission mechanism includes a housing, a shaft member, a first transmission mechanism, and a second transmission mechanism. The housing is mounted on the color printer main body. The shaft member is mounted in the housing so as to be axially rotatable, and mobile in the axial direction. The first transmission mechanism is mounted in the housing and transmits the drive power of the drive motor to the shaft member, so that the shaft member can be moved in the axial direction. The second transmission mechanism is mounted in the housing and transmits the drive power of the drive motor to the shaft member, so that the shaft member can be rotated.

24 Claims, 19 Drawing Sheets

COLOR IMAGE FORMING DEVICE HAVING AN OUTPUT TONER TRANSPORT MEMBER

CROSS-REFERENCE TO RELATED APPLICATIONS

This application claims priority to Japanese Patent Application Nos. 2005-252489, 2006-208760, and 2006-208761. The entire disclosures of Japanese Patent Application Nos. 2005-252489, 2006-208760, and 2006-208761 are hereby incorporated herein by reference.

BACKGROUND OF THE INVENTION

1. Field of the Invention

The present invention relates to an image forming device.

2. Background Information

Conventional color image forming devices principally comprise a image forming device main body, a plurality of photosensitive drums, a plurality of development devices, a plurality of toner holding containers, and a plurality of drive power transmission mechanisms (for example, see JP-09-0160338-A). The photosensitive drums are rotatably mounted in the image forming device main body. The development devices serve to supply toner to the surface of the photosensitive drums, and are mounted in the image forming device main body. The toner holding containers comprise toner holding container main bodies, toner stirring members, and toner transport members. The toner holding container main bodies are mounted in juxtaposition on the image forming device main body. The toner stirring members serve to stir the toner that is held in the toner holding container main bodies, and are rotatably mounted within the toner holding container main bodies. The toner transport members serve to transport the toner that has been stirred by the toner stirring members, and are rotatably mounted within the toner holding container main bodies. The drive power transmission mechanisms comprise a housing that is mounted on the image forming device main body, drive means, such as a drive motor, that is mounted on the housing, and a transmission mechanism for transmitting the drive power of the drive motor to the toner stirring member.

In such a color image forming device, when each of the drive motors of the drive power transmission mechanisms rotate, the toner stirring members are rotated by way of the transmission mechanisms. Then, when the toner stirring members rotate, the toner transport members are rotated by gears, which are provided between the toner stirring members and the toner transport members.

In conventional color image forming devices, because the toner stirring members in each of the plurality of toner holding containers are separately driven, a plurality of drive power transmission mechanisms are mounted in the image forming device main body. And because, in such color image forming devices, drive motors are mounted in the housings of a plurality of drive power transmission mechanisms, each of these housings themselves must be large. As it is necessary to reserve an amount of space that corresponds to these large sized housings for the drive power transmission mechanisms within the image forming device main body for mounting the housings in the image forming device main body, it is difficult to reduce the size of the color image forming device.

Meanwhile, in conventional color image forming devices, drive motors are installed for each of the plurality of drive power transmission mechanisms. With color image forming devices of this sort, because it is necessary to provide as many drive motors as there are drive power transmission mechanisms, the cost of manufacturing the drive power transmission mechanisms, which is to say, the cost of manufacturing the color image forming device, increases with the number of drive power transmission mechanisms.

In view of the above, it will be apparent to those skilled in the art from this disclosure that there exists a need to make the drive power transmission mechanism more compact and to reduce the costs of manufacturing the drive power transmission mechanism.

SUMMARY OF THE INVENTION

The image forming device according to a first aspect of the present invention comprises an image forming device main body, an image bearing member, a development device, a plurality of toner holding containers, a transported toner holding unit, and a drive power transmission mechanism.

The image bearing member is rotatably mounted on the image forming device main body. The development device serves to supply toner to the surface of the image bearing member, and is mounted on the image forming device main body. The plurality of toner holding containers each comprise a toner holding container main body, a toner stirring member, and a toner transport member. The toner holding container main bodies are mounted in juxtaposition on the image forming device main body. The toner stirring members serve to stir the toner that is held in the toner holding container main bodies, and are rotatably mounted within the toner holding container main bodies. The toner transport members serve to transport the toner that has been stirred by the toner stirring members, and are rotatably mounted within the toner holding container main bodies. The transported toner holding unit is provided in the vicinity of the toner holding container main bodies. The transported toner holding unit comprises transported toner holding unit main bodies and output toner transport members. The transported toner holding unit main bodies hold toner that was transported by the toner transport members. The output toner transport member is rotatably mounted within the transported toner holding unit main body. The output toner transport member transports toner that has been held in the transported toner holding unit main body, so as to output the toner from the transported toner holding unit main body.

The drive power transmission mechanism comprises a housing, a shaft member, a first transmission mechanism and a second transmission mechanism. The housing is mounted on the image forming device main body. The shaft member is mounted in the housing so as to be axially rotatable, and mobile in the axial direction. The first transmission mechanism is mounted in the housing and transmits the drive power of the drive means to the shaft member, so that the shaft member can be moved in the axial direction. The second transmission mechanism is mounted in the housing and transmits the drive power of the drive means to the shaft member, so that the shaft member can be rotated.

In this image forming device, the housing of the drive power transmission function is mounted on the image forming device main body, so that the shaft member of the drive power transmission mechanism crosses the rotary shaft of the output toner transport member. Then, the shaft member is moved in the axial direction with the drive power that is transmitted to the shaft member by the first transmission mechanism, and the shaft member is rotated with the drive power that is transmitted to the shaft member by the second transmission mechanism. As a result, the output toner transport member that is to be driven is rotated.

Here, by incrementally moving the shaft member in the axial direction with one drive power transmission mechanism, and after moving the shaft member, rotating the shaft member, it is possible to transmit the drive power of the drive means to the output toner transport members of a plurality of toner holding containers. In other words, the drive power can be separately transmitted to the plurality of toner holding containers. Consequently, it is not necessary to provide a plurality of drive means, which allows for a reduction in the size of the drive power transmission mechanism, and a reduction in the manufacturing costs of the drive power transmission mechanism. Furthermore, because the housing of the drive power transmission function is mounted on the image forming device main body, so that the shaft member of the drive power transmission mechanism crosses the rotary shaft of the output toner transport member, by juxtaposing the drive power transmission mechanism with the plurality of toner holding container main bodies, it is possible to reduce the dimensions of the image forming device main body in one direction (the direction that is orthogonal to the direction of juxtaposition). In other words, it is possible to reduce the size of the image forming device.

In the image forming device according a second aspect of the present invention, the image forming device of the first aspect is such that the shaft member comprises a plurality of first gears. The plurality of first gears are mounted so as not to be rotatable around the shaft, disposed at intervals in the axial direction of the shaft. The output toner transport member comprises a second gear, which is mounted so as not to be rotatable around the rotary shaft. With an image forming device of this sort, when the shaft member has been moved in the axial direction by the first transmission mechanism, any one of the plurality of first gears meshes with the second gear of the output toner transport member that is to be driven.

In this case, when the shaft member is moved in the axial direction, any one of the plurality of first gears meshes with the second gear of the output toner transport member that is to be driven, whereby the drive power can be individually transmitted to the output toner transport members.

In the image forming device according to a third aspect of the present invention, the image forming device recited in the second aspect is such that either one of the first gears or the second gears are helical gears, and the other of the first gears and the second gears are capable of meshing with the helical gears.

In this case, because either one of the first gears or the second gears are helical gears, and the other of the first gears and the second gears are capable of meshing with the helical gears, even though the shaft member crosses the rotary shafts of the output toner transport members, it is possible to reliably transmit the drive power from the shaft member to the output toner transport members.

In the image forming device according to a fourth aspect of the present invention, the image forming device recited in the first aspect is such that a toner resupply member is further provided for supplying toner to the development device. The toner resupply member is provided between the toner holding container and the development device. With an image forming device of this sort, the output toner transport member and the output unit for outputting the toner that has been transported by the output toner transport member to the toner resupply member on at least one of the toner holding container main bodies that are disposed at the two ends of the row of the plurality of juxtaposed toner holding container main bodies are disposed on the adjacent toner holding container main body side.

In this case, the output toner transport member and the output unit on at least one of the toner holding container main bodies on either end of the row is disposed on the adjacent toner holding container main body side.

Consequently, even if at least one of the toner holding container main bodies on either end of the row has a large volume, it is possible to minimize the length of the toner supply route for the toner resupply member for supplying toner to the development device from the toner holding container.

For example, a case may be considered in which four conventional toner holding container main bodies are juxtaposed in the image forming device main body in the order of the yellow toner holding container main body, the magenta toner holding container main body, the cyan toner holding container main body, and the black toner holding container main body, and openings for supplying toner to the development device are disposed at uniform intervals in the lengthwise direction of the development device.

Because the toner that is held in the black toner holding container main body is more frequently used than the toners that are held in the other toner holding container main bodies, the black toner holding container main body that holds the black toner is usually formed so as to be larger, in the direction of juxtaposition, than the other toner holding container main bodies. Thus, a first gap between the yellow toner holding container main body output opening and the magenta toner holding container main body output opening, and a second gap between the magenta toner holding container main body output opening and the cyan toner holding container main body output opening are the same size, while a third gap between the cyan toner holding container main body and the black toner holding container main body output opening is larger than the first gap and the second gap. Thus, there is a risk of increasing the length of only the toner supply route of the black toner resupply member which supplies the toner from the black toner holding container main body output opening to the corresponding supply opening of the development device.

However, with the present invention, the output toner transport member and the output unit of the black toner holding container main body are disposed on the adjacent toner holding container main body side, which is to say, on the cyan toner holding container main body side. Consequently, the third gap between the cyan toner holding container main body output opening and the black toner holding container main body output opening can be substantially the same size as the first gap and the second gap. Thus, the length of the toner supply route of the black toner resupply member which supplies the toner from the black toner holding container main body output opening to the corresponding supply opening of the development device can be substantially the same as the length of the other toner resupply member toner supply routes.

In the image forming device according to a fifth aspect of the present invention, the image forming device of the fourth aspect is such that the plurality of toner holding containers each further comprise a shutter member and a shutter opening/closing mechanism. The shutter members serve to block the toner that is held in the toner holding container main body from being output to the exterior, and are mounted on the toner holding container main body. The shutter opening/closing mechanism is mounted on the toner holding container main body so that the shutter member can assume an open position and a toner blocking position.

The shutter opening/closing mechanism on a toner holding container main body other than the at least one of the toner holding container main bodies that are disposed at the two ends of the row of the plurality of juxtaposed toner holding container main bodies comprises an operating member and a third gear; i.e., a first gear of the fifth aspect. The operating member is turnably mounted on the toner holding container main body and is operated so as to position the shutter member in an open position and a toner blocking position. The third gear is mounted on the shutter member and engages with the operating member. Meanwhile, the shutter opening/closing mechanism on at least one of the toner holding container main bodies that are disposed at the two ends of the row of the plurality of toner holding container main bodies that are disposed in juxtaposition, comprises an operating member, a fourth gear, i.e., second gear of the fifth aspect and a fifth gear, i.e., a third gear of the fifth aspect. The fourth gear is mounted on the shutter member. The fifth gear is mounted on the toner holding container main body, between the operating member and the fourth gear, and engages with the operating member and the fourth gear.

In this case, even though the output toner transport member and the output unit on at least one of the toner holding container main bodies on either end of the row is disposed on the adjacent toner holding container main body side, because the shutter opening/closing mechanism on at least one of the toner holding container main bodies that are disposed at the two ends of the row comprises a fifth gear that is engaged with the operating member and the fourth gear, the direction in which the operating member turns can be the same as the direction in which the operating members on the shutter opening/closing mechanisms of the other toner holding container main bodies turn. In other words, the directions in which the operating members of all the toner holding container main body operating members turn, which is to say, the directions of operation, can be the same.

In the image forming device according to a sixth aspect of the present invention, the image forming device recited in the first aspect is such that a movement stopping mechanism is further provided for stopping the operation of the first transmission mechanism, if the shaft member has moved beyond a predetermined range of movement.

In this case, when the shaft member moves beyond the range of movement, the operation of the first transmission mechanism is stopped by the movement stopping mechanism, whereby it is possible to prevent the shaft member from touching other members and damaging the other members.

In the image forming device according to a seventh aspect of the present invention, the image forming device according to a sixth aspect is such that the shaft member comprises a shaft and a rack. The rack is provided on the shaft and moves together with the shaft. The first transmission mechanism comprises a worm gear for meshing with the rack. The movement stopping mechanism is a mechanism for disengaging the meshing of the rack and the worm gear.

In this case, when the shaft member moves beyond the range of movement, the meshing of the rack and the worm gear is disengaged by the movement stopping mechanism. Thus, when the meshing of the rack and the worm gear is disengaged, the power transmission between the rack and the worm gear is broken so that the shaft member stops.

In the image forming device according to an eighth aspect of the present invention, the image forming device of the seventh aspect is such that the rack is mounted so as to be axially turnable around the shaft. The movement stopping mechanism comprises a projection which is disposed fixed in place so as to be immobile with respect to the rack, and a striking unit having an inclined face, which is provided on the rack so as to be able to strike the projection.

In this case, if the rack moves beyond the range of movement, together with the shaft member, the rack is axially turned around the shaft, as a result of the striking unit striking the projection, so as to disengage the meshing of the rack and the worm gear.

In the image forming device according to a ninth aspect of the present invention, the image forming device of the eighth aspect is such that detection means is further provided for detecting an initial position of the shaft member at an edge of the range of movement. Here, if the rack moves beyond the range of movement, together with the shaft member, touching of the detection means is avoided by turning the rack.

In this case, even if the rack moves beyond the range of movement, together with the shaft member, the rack does not touch the detection means, which allows damage to the detection means to be prevented.

In the image forming device according to a tenth aspect of the present invention, the image forming device of the seventh aspect is such that a support member is further provided. The support member supports the rack so that the rack and the worm gear remain meshed while the shaft member moves within a predetermined range of movement. The support member also supports the rack so that, when the shaft member moves beyond the predetermined range of movement, the meshing between the rack and the worm gear can be disengaged.

In this case, the rack is supported by the support member so that the rack and the worm gear remained meshed when the shaft member moves within a predetermined range of movement.

In the image forming device according to an eleventh aspect of the present invention, the image forming device of the first aspect is such that the shaft member comprises a plurality of first gears. The plurality of first gears are arranged at intervals in the axial direction of the shaft and non-rotatably mounted on the shaft. The output toner transport member comprises a second gear non-rotatably mounted on the rotary shaft. With this type of image forming device, any one of the plurality of first gears will mesh with the second gear of the output toner transport member when the shaft member is moved in the axial direction by the first transmission mechanism.

In this case, because any one of the plurality of first gears will mesh with the second gear of the output toner transport member when the shaft member is driven in the axial direction, drive force can be separately input to the output toner transport member.

In the image forming device according to a twelfth aspect of the present invention, the image forming device of the eleventh aspect is such that detection means is further provided for detecting an initial position of the shaft member at an edge of the range of movement. The first transmission mechanism moves the shaft member from the initial position by a distance corresponding to a position at which meshing with the input gear is possible.

In the image forming device according to a thirteenth aspect of the present invention, the image forming device of the first aspect is such that the first transmission mechanism further comprises a first clutch for transmitting/disengaging the drive power for moving the shaft member, and brake means for impeding the movement of the shaft member resulting from drag torque when the first clutch is in the power disengagement state.

In this case, when the shaft member is moved so as to be positioned at the predetermined position, the first clutch enters the power disengagement state. At this time, drag torque is usually generated in the clutch units, so there is a risk of the shaft member moving. However, because the first transmission mechanism is provided with brake means, it is possible to impede the movement of the shaft member with the brake means. Thus, it is possible to prevent movement of the shaft member when the first clutch is in the power disengagement state, so as to allow for good power transmission by way of the shaft member.

In the image forming device according to a fourteenth aspect of the present invention, the image forming device of the thirteenth aspect is such that the shaft member comprises a shaft and a rack, which is provided on the shaft, and which moves together with the shaft. The first transmission mechanism comprises a worm gear for meshing with the rack. The brake means is a friction member for limiting the turn of the worm gear.

In the image forming device according to a fifteenth aspect of the present invention, the image forming device of the first aspect is such that the second transmission mechanism further comprises a second clutch for transmitting/disengaging the power for turning the shaft member.

In this case, by causing the second clutch to enter the power disengagement state, it is possible to stop operation of the second transmission mechanism without stopping the drive system.

In the image forming device according to a sixteenth aspect of the present invention, the image forming device of the first aspect is such that drive power is supplied to the first transmission mechanism and the second transmission mechanism from the same drive source.

In this case, it is possible to drive both the first transmission mechanism and at the second transmission mechanism with one drive source. Consequently, it is possible to achieve reductions in space and reductions in cost.

By virtue of the present invention, by incrementally moving the shaft member in the axial direction, and after moving the shaft member, rotating the shaft member, it is possible to transmit the drive power of the drive means to the output toner transport members of a plurality of toner holding containers, with one drive power transmission mechanism. In other words, the drive power of the drive means can be separately transmitted to the plurality of toner holding containers. Consequently, it is not necessary to provide a plurality of drive means, which allows for a reduction in the size of the drive power transmission mechanism, and a reduction in the manufacturing costs of the drive power transmission mechanism. In addition, because the housing of the drive power transmission function is mounted on the image forming device main body, so that the shaft member of the drive power transmission mechanism crosses the rotary shaft of the output toner transport member, by juxtaposing the drive power transmission mechanism with the plurality of toner holding container main bodies, it is possible to reduce the dimensions of the image forming device main body in one direction (the direction that is orthogonal to the direction of juxtaposition). In other words, it is possible to reduce the size of the image forming device. Furthermore, when the shaft member moves beyond a predetermined range of movement, the shaft member can be prevented from touching other members so as to prevent damage to the other members. Moreover, when the clutch is in the power disengagement state, it is possible to limit the movement of the shaft member resulting from drag torque with the brake means.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

1. Overview

Figure 1:
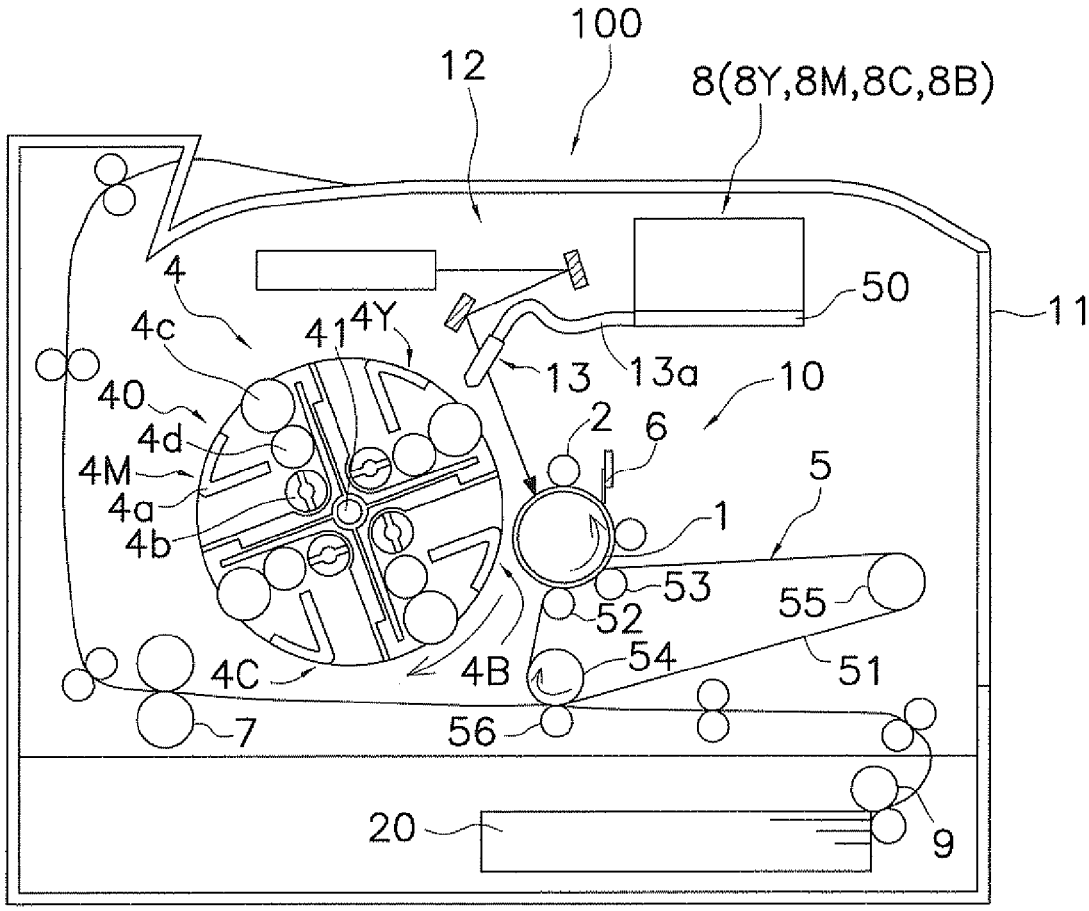
FIG. 1 is a schematic sectional view of a color printer according to a first embodiment of the present invention.
Figure 2:
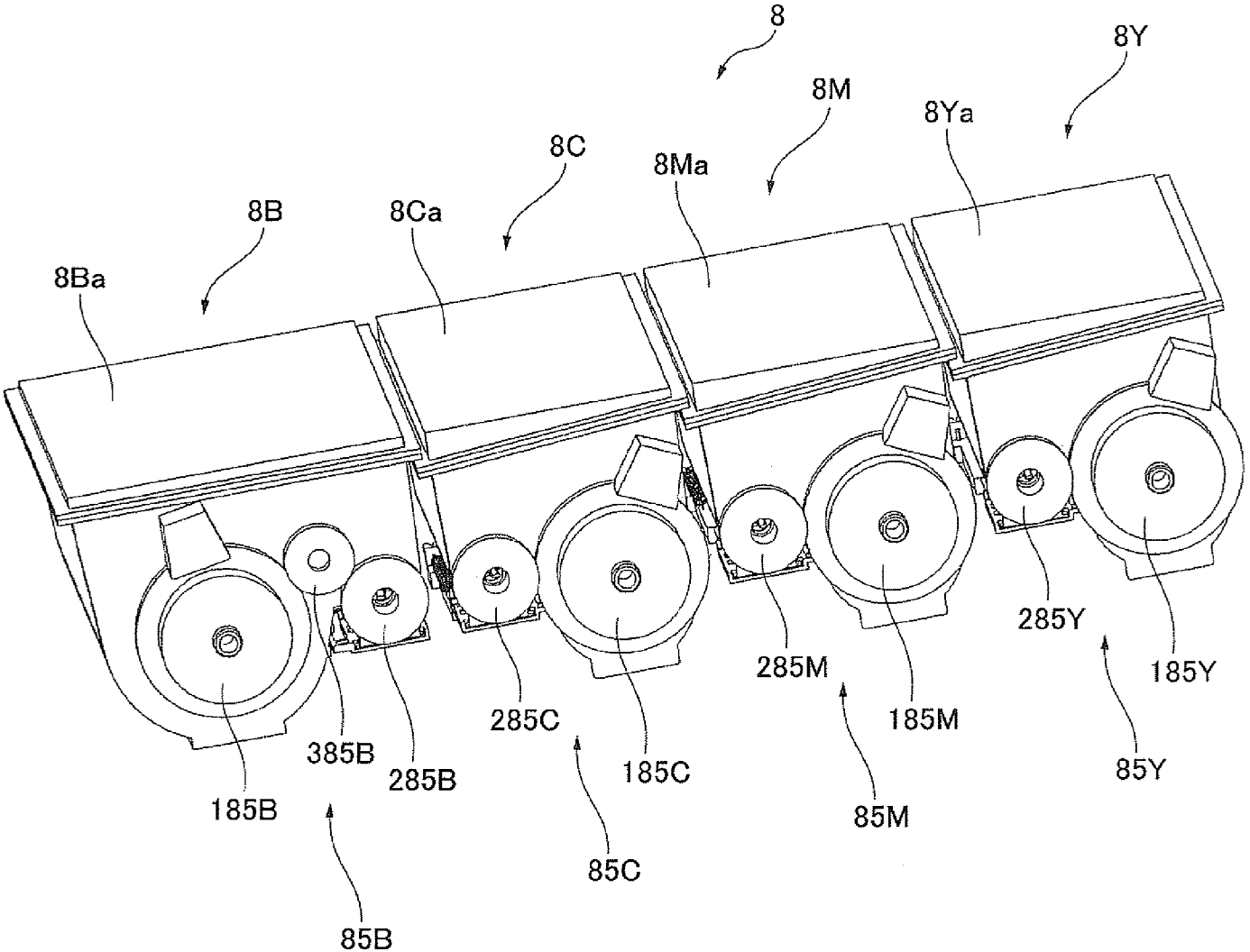
FIG. 2 is an external perspective view of a toner container.

FIG. 1 is a drawing schematically illustrating the structure of a color printer to which one mode of embodiment of the present invention has been applied.

Figure 6:
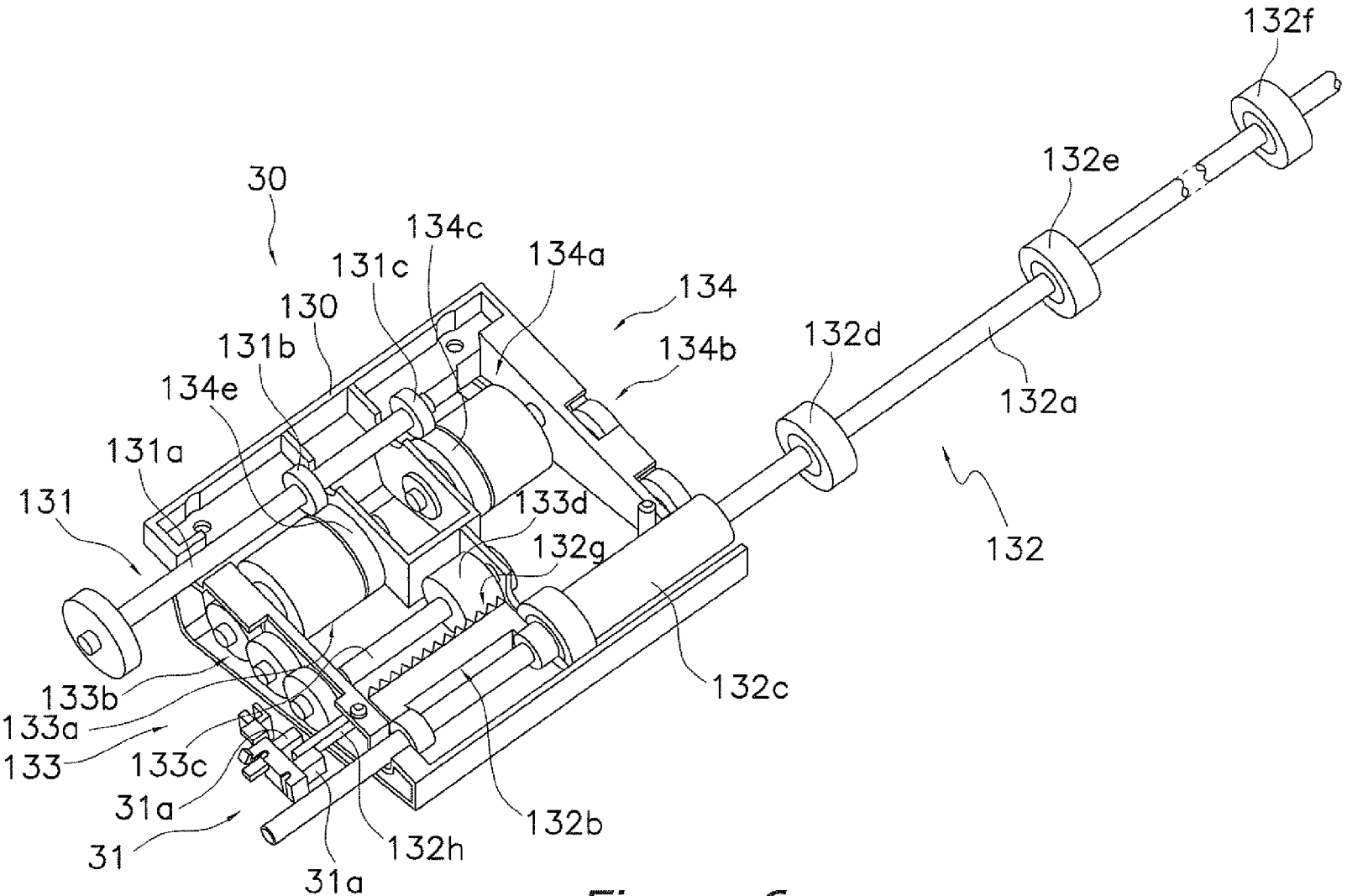
FIG. 6 is a perspective view seen from the top of the drive power transmission mechanism.
Figure 7:
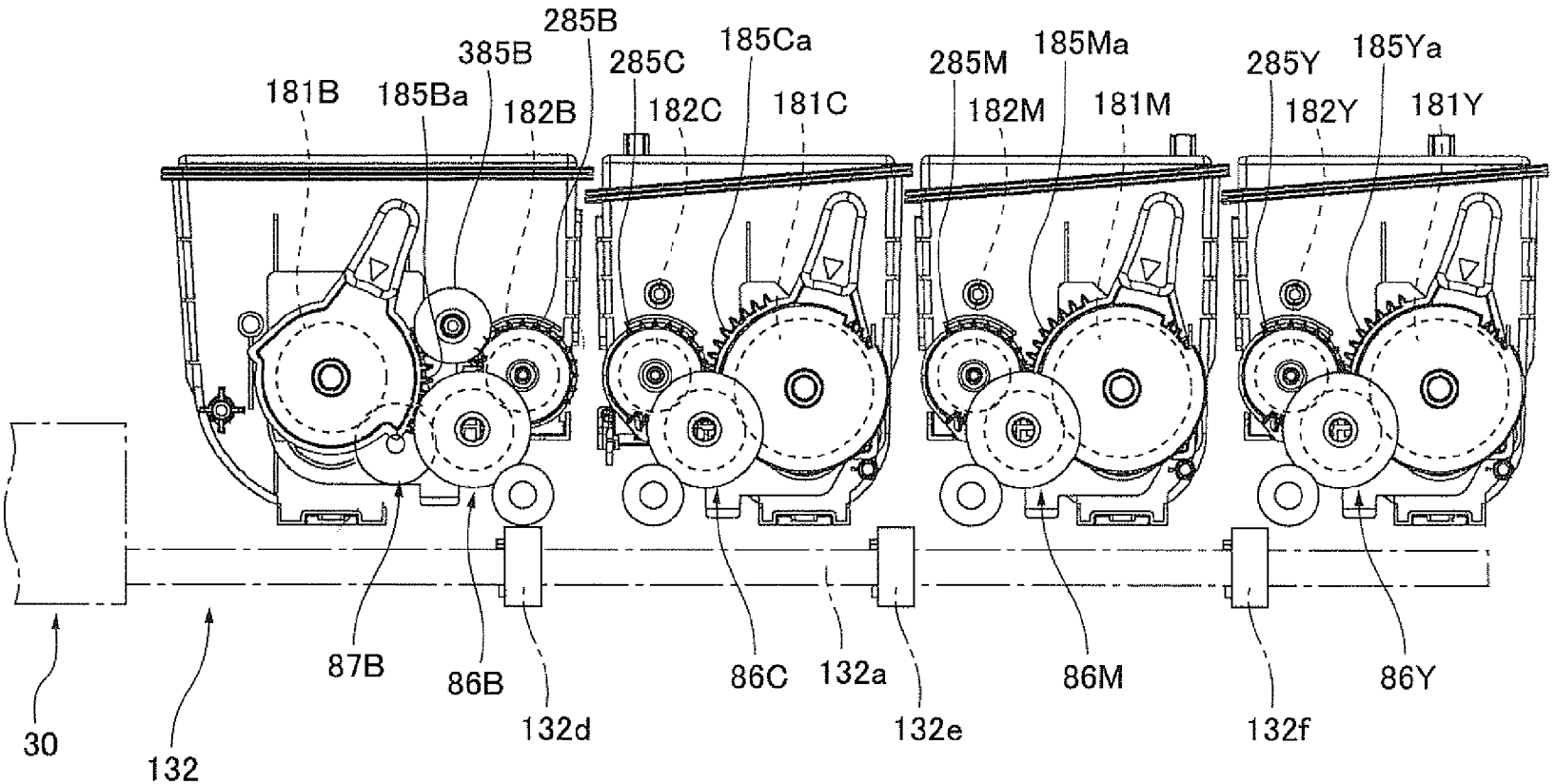
FIG. 7 is a sectional view of the toner container seen from the side facing the aforementioned one side.

As shown in FIG. 1, FIG. 6 and FIG. 7, the color printer 100 principally comprises a color printer main body 11, an image forming unit 10, a toner container 8, a transported toner holding unit 50, a drive power transmission mechanism 30, a movement detection sensor 31, a control unit (not shown), and a toner resupply pipe 13.

The image forming unit 10 is provided substantially in the center of the color printer main body 11.

2. Image Forming Unit

As shown in FIG. 1, the image forming unit 10 comprises a photosensitive drum 1, a corona unit 2, a rotary development device 4, a transfer device 5, a cleaning device 6, and a laser unit 12. The corona unit 2, the rotary development device 4, the transfer device 5, the cleaning device 6, and the laser unit 12, are disposed around the photosensitive drum 1. Note that a fixing device 7 is disposed downstream in the direction of paper transport from the photosensitive drum 1. The fixing device 7 is a device for a fixing a toner image that has been transferred to a transfer material. Furthermore, a paper supply unit 20 is provided below the image forming unit 10 and a paper supply roller 9 is disposed in the direction of paper supply from the paper supply unit.

The photosensitive drum 1 is rotatably mounted within the color printer main body 11. An electrostatic latent image can be formed by the laser unit 12 on the surface of the photosensitive drum 1. The corona unit 2 is a device for uniformly charging the photosensitive drum 1, which is disposed above the photosensitive drum 1.

The transfer device 5 is a device for transferring the toner image on the photosensitive drum 1 to the paper, and comprises an intermediate transfer belt 51, primary transfer rollers 52, 53, a drive roller 55, a secondary transfer counter-roller 54, and a secondary transfer roller 56. The intermediate transfer belt 51 is mounted around each of the primary transfer rollers 52, 53, the drive roller 55, and the secondary transfer counter-roller 54. This intermediate transfer belt 51 is rotated around the primary transfer rollers 52, 53, the drive roller 55 and the secondary transfer counter-roller 54 by the drive power of the drive roller 55. A toner image that is formed on the photosensitive drum 1 is thus transferred to the intermediate transfer belt 51, which temporarily bears the transferred toner image. The secondary transfer roller 56 is disposed in a position facing the secondary transfer counter-roller 54 at the outer circumferential face of the intermediate transfer belt 51. Secondary transfer of the toner image to the transfer material is performed with this secondary transfer roller 56.

The cleaning device 6 is a device for removing adherents such as remaining developer that has remained on the photosensitive drum 1, and in this color printer 100, a cleaning blade is provided.

The laser unit 12 is mounted within the color printer main body 11. This laser unit 12 forms an electrostatic latent image on the photosensitive drum 1, by scanning the photosensitive drum 1 on the basis of image information processed by a controller (not shown). The laser unit 12 comprises a semiconductor laser, various lenses, a polygon mirror, a mirror rotating motor and the like.

3. Toner Container

The toner container 8 is a container for supplying toner to the rotary development device 4. The toner container 8 comprises a plurality of containers such as a yellow container 8Y, a magenta container 8M, a cyan container 8C and a black container 8B. These containers 8Y, 8M, 8C, 8B are mounted in juxtaposition within the color printer main body 11.

As shown in FIGS. of 2 through 5, each of the plurality of toner containers 8Y, 8M, 8C, 8B respectively have a toner container main body 8Ya, 8Ma, 8Ca, 8Ba, a toner stirring member 81Y, 81M, 81C, 81B, a toner transport member 82Y, 82M, 82C, 82B, a shutter member 84Y, 84M, 84C, 84B, and a shutter opening/closing mechanism 85Y, 85M, 85C, 85B.

The plurality of toner container main bodies 8Ya, 8Ma, 8Ca, 8Ba are juxtaposed above the photosensitive drum 1, aligned in the direction of axis of rotation of the photosensitive drum 1, which is to say, in the direction of a rotary shaft 41 of the rotary development device 4. The plurality of toner container main bodies 8Ya, 8Ma, 8Ca, 8Ba have toner stirring units 80Ya, 80Ma, 80Ca, 80Ba, which are spaces for stirring toner, and toner transport units 80Yb, 80Mb, 80Cb, 80Bb, which are spaces for transporting toner. The bottoms of the toner stirring units 80Ya, 80Ma, 80Ca, 80Ba are substantially semicircular in shape. The bottoms of the toner transport units 80Yb, 80Mb, 80Cb, 80Bb are substantially semicircular in shape. Here, the toner transport unit 80Bb of the black toner container main body 8Ba, is formed on the side of the cyan toner container main body 8Ca.

At the bottom of these toner transport units 80Yb, 80Mb, 80Cb, 80Bb, second output units 80Yc, 80Mc, 80Cc, 80Bc, for example, openings, are formed for outputting toner that is transported by the toner transport members 82Y, 82M, 82C, 82B, which are described below, to the transported toner holding unit 50, for example, transported toner holding unit main bodies 50Y, 50M, 50C, 50B. Here, the second output units 80Yc, 80Mc, 80Cc, 80Bc are formed on the shutter opening/closing mechanisms 85Y, 85M, 85C, 85B side, on the bottoms of the toner transport units 80Yb, 80Mb, 80Cb, 80Bb.

Figure 8:
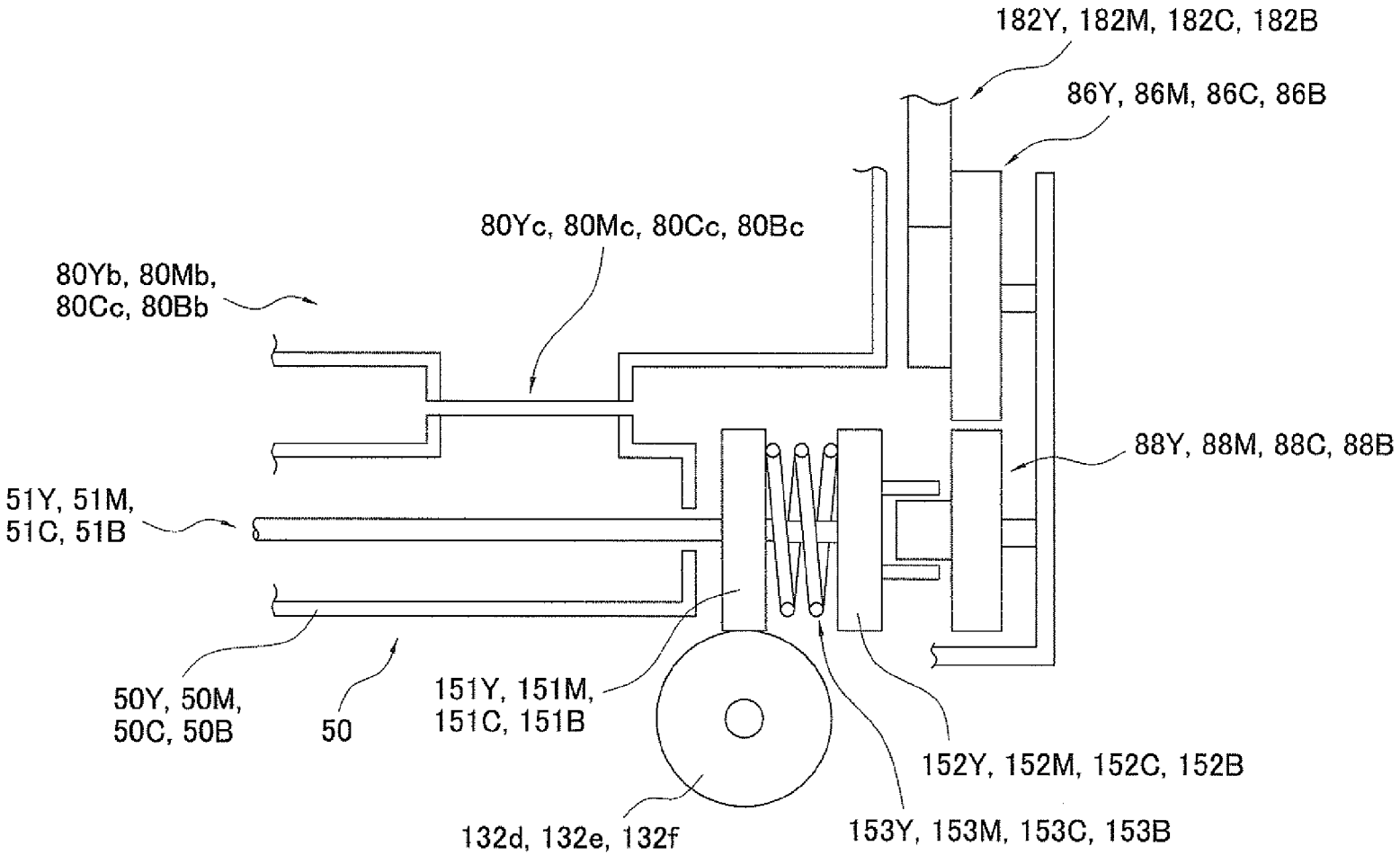
FIG. 8 is an enlarged sectional view of one end of the transported toner holding unit.

Furthermore, as shown in FIG. 7 and FIG. 8, the plurality of toner containers 8Y, 8M, 8C, 8B comprise first intermediate gears 86Y, 86M, 86C, 86B and container coupling gears 88Y, 88M, 88C, 88B. The first intermediate gears 86Y, 86M, 86C, 86B are rotatably mounted on the lateral faces of the toner container main bodies 8Ya, 8Ma, 8Ca, 8Ba on the shutter opening/closing mechanisms 85Y, 85M, 85C, 85B side. The first intermediate gears 86Y, 86M, 86C, 86B are two-level gears comprising a large diameter gear and a small diameter gear. The large diameter gears of the first intermediate gears 86Y, 86M, 86C, 86B mesh with the container coupling gears 88Y, 88M, 88C, 88B, which are rotatably mounted on the lateral faces of the toner container main bodies 8Ya, 8Ma, 8Ca, 8Ba below the first intermediate gears 86Y, 86M, 86C, 86B. The small diameter gears of the first intermediate gears 86Y, 86M, 86C, 86B mesh with second member rotating gears 182Y, 182M, 182C, 182B.

Here, the black toner container 8B comprises a second intermediate gear 87B. The second intermediate gear 87B is rotatably mounted on the lateral face of the toner container main body 8Ba, on the shutter opening/closing mechanism 85B side. This second intermediate gear 87B is disposed between the small diameter gear of the first intermediate gear 86B and a third member rotating gear 181B of a toner stirring member 81B, which is described below, and meshes with the small diameter gear of the first intermediate gear 86B and the third member rotating gear 181B.

The toner stirring members 81Y, 81M, 81C, 81B serve to stir the toner that is held in the toner container main bodies 8Ya, 8Ma, 8Ca, 8Ba, and are rotatably mounted within the toner container main bodies 8Ya, 8Ma, 8Ca, 8Ba. Here, the toner stirring members 81Y, 81M, 81C, 81B are rotatably mounted in the toner stirring units 80Ya, 80Ma, 80Ca, 80Ba of the toner container main bodies 8Ya, 8Ma, 8Ca, 8Ba. The toner stirring members 81Y, 81M, 81C, 81B comprise third member rotating gears 181Y, 181M, 181C, 181B which are non-rotatably mounted on the rotary shafts thereof. The third member rotating gears 181Y, 181M, 181C mesh with the small diameter gears of the first intermediate gears 86Y, 86M, 86C. The third member rotating gear 181B meshes with the second intermediate gear 87B.

The toner transport members 82Y, 82M, 82C, 82B serve to transport the toner that is stirred by the toner stirring members 81Y, 81M, 81C, 81B, and are rotatably mounted within the toner container main bodies 8Ya, 8Ma, 8Ca, 8Ba. Here, the toner transport members 82Y, 82M, 82C, 82B are rotatably mounted in the toner transport units 80Yb, 80Mb, 80Cb, 80Bb of the toner container main bodies 8Ya, 8Ma, 8Ca, 8Ba. Furthermore, the toner transport member 82B of the black toner container main body 8Ba is disposed on the adjacent toner container main body side, which is to say, the cyan toner container main body 8Ca side. Here, the toner transport member 82B of the black toner container main body 8Ba is rotatably mounted in the toner transport unit 80Bb, which is provided on the cyan toner container main body 8Ca side.

Figure 3:
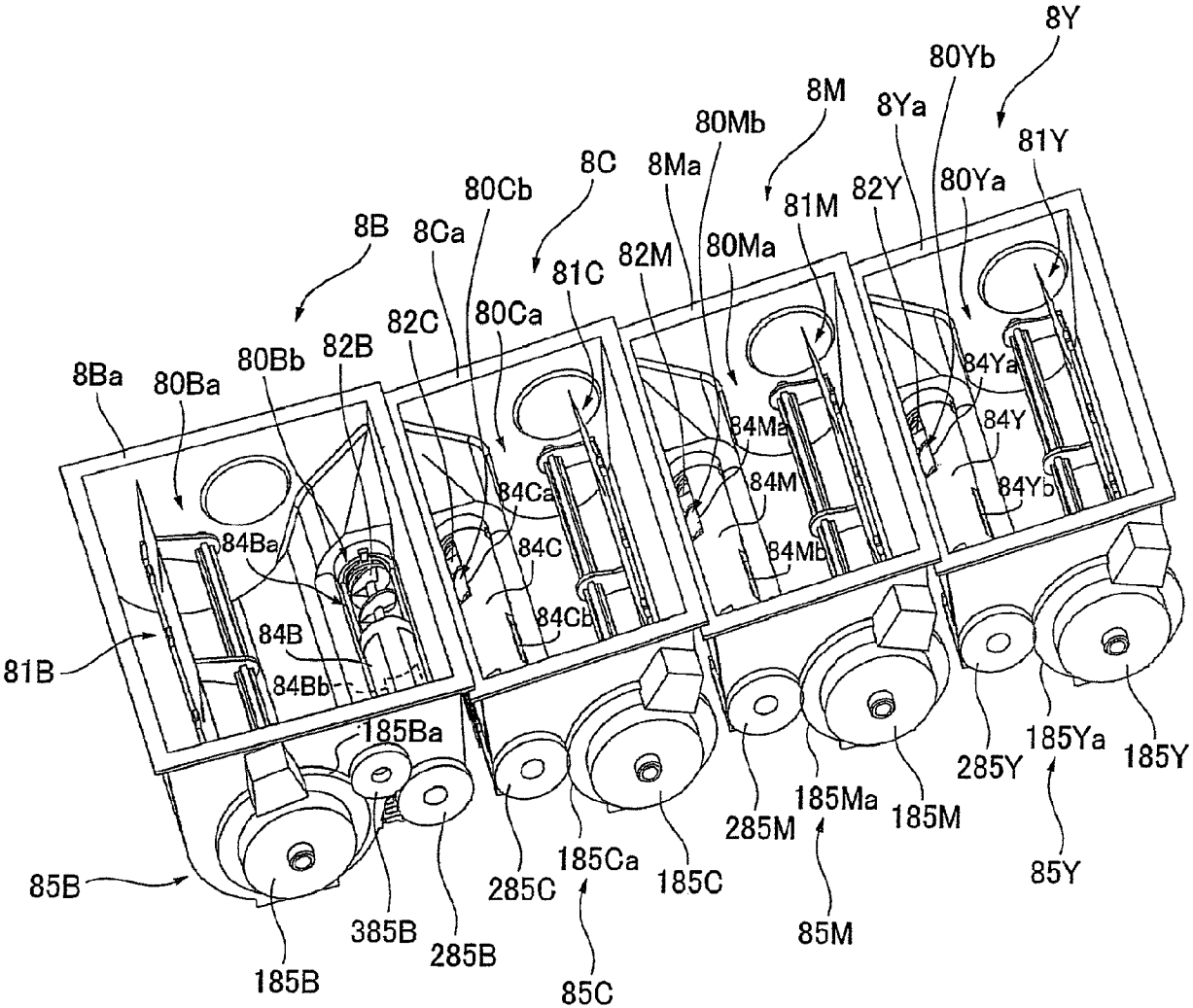
FIG. 3 is a perspective view for describing the interior of the toner container.
Figure 4:
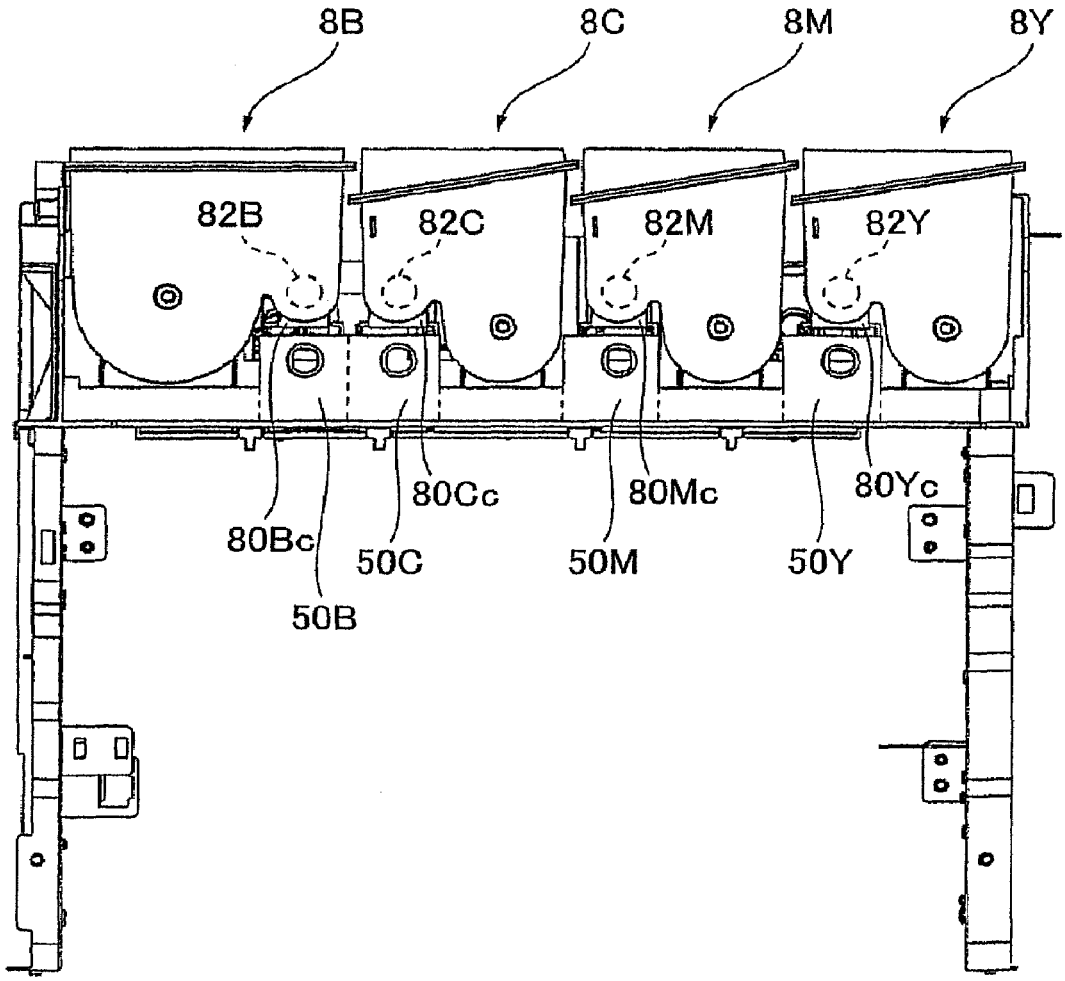
FIG. 4 is a side view seen from one side of the toner container.

The toner transport members 82Y, 82M, 82C, 82B have second member rotating gears 182Y, 182M, 182C, 182B, which are non-rotatably mounted on the rotary shafts thereof. The second member rotating gears 182Y, 182M, 182C, 182B mesh with the small diameter gears of the first intermediate gears 86Y, 86M, 86C, 86B. As shown in FIG. 3, the shutter members 84Y, 84M, 84C, 84B serve to block toner that is held in the toner container main bodies 8Ya, 8Ma, 8Ca, 8Ba from leaking out from the toner container main bodies 8Ya, 8Ma, 8Ca, 8Ba. The shutter members 84Y, 84M, 84C, 84B are formed as cylinders. The shutter members 84Y, 84M, 84C, 84B comprise first openings 84Ya, 84Ma, 84Ca, 84Ba and second openings 84Yb, 84Mb, 84Cb, 84Bb. These shutter members 84Y, 84M, 84C, 84B are rotatably mounted within the toner transport units 80Yb, 80Mb, 80Cb, 80Bb.

Shutter opening/closing mechanisms 85Y, 85M, 85C, 85B are mounted on the shutter members 84Y, 84M, 84C, 84B and the toner container main bodies 8Ya, 8Ma, 8Ca, 8Ba, in order for the shutter members 84Y, 84M, 84C, 84B to be able to assume an open position and a toner blocking position. In FIG. 3, an example is shown wherein the shutter members 84Y, 84M, 84C are in the toner blocking position, and the shutter member 84B is in the open position.

The first shutter opening/closing mechanisms 85Y, 85M, 85C, which are mounted on the toner container main bodies 8Ya, 8Ma, 8Ca, comprise first operating members 185Y, 185M, 185C and first engagement gears (third gears,third gears, i.e., first gears of the fifth aspect) 285Y, 285M, 285C. The first operating members 185Y, 185M, 185C operate so as to position the shutter members 84Y, 84M, 84C in the open position or the toner blocking position, and are turnably mounted on the toner container main bodies 8Ya, 8Ma, 8Ca. As shown in FIG. 3 and FIG. 7, these first operating members 185Y, 185M, 185C comprise first gear units 185Ya, 185Ma, 185Ca. First engagement gears 285Y, 285M, 285C are mounted at one of the ends of the shutter members 84Y, 84M, 84C. The teeth of the first engagement gears 285Y, 285M, 285C mesh with the first operating members 185Y, 185M, 185C, which is to say, with the first gear units 185Ya, 185Ma, 185Ca of the first operating members 185Y, 185M, 185C.

With the first shutter opening/closing mechanisms 85Y, 85M, 85C, if the first operating members 185Y, 185M, 185C are turned counterclockwise, the first engagement gears 285Y, 285M, 285C, which mesh with the first gear units 185Ya, 185Ma, 185Ca of the first operating members 185Y, 185M, 185C, rotate clockwise. Thereupon, the shutter members 84Y, 84M, 84C also rotate clockwise so that the shutter members 84Y, 84M, 84C are positioned in the open position. Which is to say, the first openings 84Ya, 84Ma, 84Ca, 84Ba of the shutter members 84Y, 84M, 84C are disposed above the rotary shafts of the shutter members 84Y, 84M, 84C. Then, the second openings 84Yb, 84Mb, 84Cb, 84Bb of the shutter members 84Y, 84M, 84C are positioned at the location of the second output units 80Yc, 80Mc, 80Cc, 80Bc, which are formed on the bottom face of the toner transport units 80Yb, 80Mb, 80Cb.

Furthermore, in this situation, if the first operating members 185Y, 185M, 185C are turned clockwise, the first engagement gears 285Y, 285M, 285C, which mesh with the first gear units 185Ya, 185Ma, 185Ca of the first operating members 185Y, 185M, 185C, rotate counterclockwise. Thereupon, the shutter members 84Y, 84M, 84C also rotate counterclockwise, so that the shutter members 84Y, 84M, 84C are positioned in the toner blocking position. Which is to say, the first openings 84Ya, 84Ma, 84Ca, 84Ba of the shutter members 84Y, 84M, 84C are disposed towards the lateral face of the color printer main body 11. Then, the second openings 84Yb, 84Mb, 84Cb, 84Bb of the shutter members 84Y, 84M, 84C are positioned on the side away from the lateral face of the color printer main body 11.

The second shutter opening/closing mechanism 85B, which is mounted on the toner container main body 8Ba, comprises a second operating member 185B, a second engagement gear (fourth gear, i.e., second gears of the fifth aspect) 285B, and a third engagement gear (fifth gear, i.e., third gears of the fifth aspect) 385B. The operating member 185B operates so as to position the shutter member 84B in the open position or the toner blocking position, and is turnably mounted on the toner container main body 8Ba. This second operating member 185B comprises a second gear unit 185Ba. The second engagement gear 285B is mounted on one end of the shutter member 84B. The third engagement gear 385B is rotatably mounted on the toner container main body 8Ba, between the second operating member 185B and the second engagement gear 285B. This third engagement gear 385B engages with the second operating member 185B, which is to say, the second gear unit 185Ba of the second operating member 185B and the second engagement gear 285B.

With the second shutter opening/closing mechanism 85B, if the second operating member 185B is turned counterclockwise, the third engagement gear 385B, which is engaged with second gear unit 185Ba of the second operating member 185B, rotates clockwise, and the second engagement gear 285B, which is engaged with the third engagement gear 385B, rotates counterclockwise. Thereupon, the shutter member 84B also rotates counterclockwise so that the shutter member 84B is positioned in the open position. In other words, the first opening 84Ba of the shutter member 84B is disposed above the rotary shaft of the shutter member. Then, the second opening 84Bb of the shutter member 84B is positioned at the location of the second output unit 80Bc, which is formed on the bottom face of the toner transport unit 80Bb.

Furthermore, in this situation, if the second operating member 185B is turned clockwise, the third engagement gear 385B, which meshes with the second gear unit 185Ba of the second operating member 185B, rotates counterclockwise, and the second engagement gear 285B, which meshes with the third engagement gear 385B rotates clockwise. Thereupon, the shutter member 84B also rotates clockwise, so as to position the shutter member 84B in the toner blocking position. In other words, the first opening 84Ba of the shutter member 84B is disposed towards the lateral face of the color printer main body 11. Thus, the second opening 84Bb of the shutter member 84B, is disposed on the side away from the lateral face of the color printer main body 11.

Figure 5:
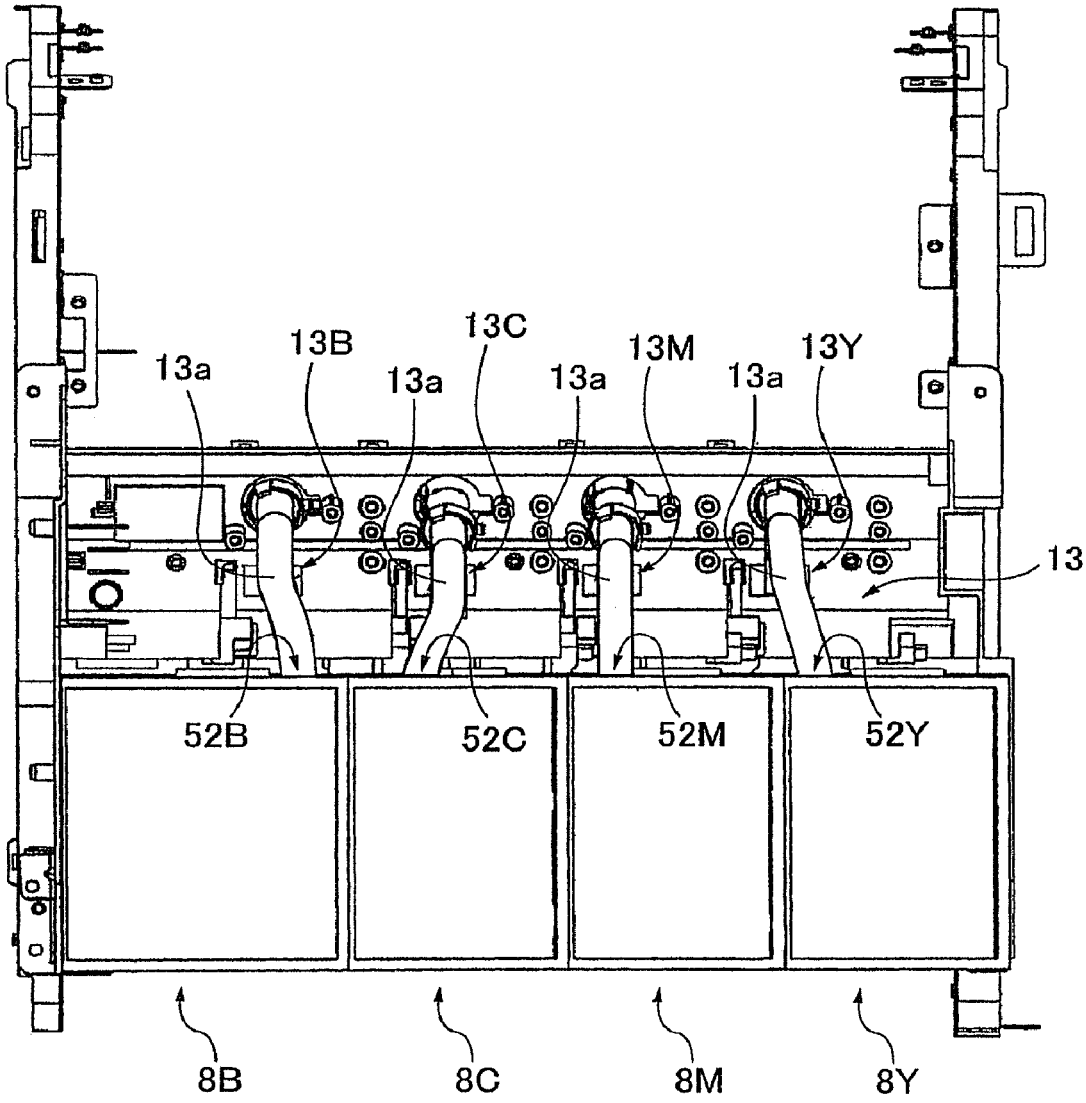
FIG. 5 is a top view seen from the top of the toner container.

As shown in FIG. 1, FIG. 5 and FIG. 8, the transported toner holding unit 50 is provided in the vicinity of the plurality of toner container main bodies 8Ya, 8Ma, 8Ca, 8Ba. Here, the transported toner holding unit 50 is provided below the plurality of toner container main bodies 8Ya, 8Ma, 8Ca, 8Ba, for example, below the place at which the toner transport members 82Y, 82M, 82C, 82B are mounted. The transported toner holding unit 50 comprises transported toner holding unit main bodies 50Y, 50M, 50C, 50B, output toner transport members 51Y, 51M, 51C, 51B, and first output units 52Y, 52M, 52C, 52B.

The transported toner holding unit main bodies 50Y, 50M, 50C, 50B are units for holding toner that is transported by the toner transport members 82Y, 82M, 82C, 82B, and are mounted on the color printer main body 11.

The output toner transport members 51Y, 51M, 51C, 51B serve to transport toner that is held in the transported toner holding unit main bodies 50Y, 50M, 50C, 50B, and output it from the transported toner holding unit main body 50, and are rotatably mounted within the transported toner holding unit main bodies 50Y, 50M, 50C, 50B. The output toner transport members 51Y, 51M, 51C, 51B comprise first member rotating gears (second gears) 151Y, 151M, 151C, 151B, coupling gears 152Y, 152M, 152C, 152B, and biasing members 153Y, 153M, 153C, 153B.

The first member rotating gears 151Y, 151M, 151C, 151B are mounted non-rotatably on the rotary shaft of the output toner transport members 51Y, 51M, 51C, 51B. The first member rotating gears 151Y, 151M, 151C, 151B are second helical gears, which can mesh with first helical gears (shaft gears, first gears) 132*d*, 132*e*, 132*f*.

The coupling gears 152Y, 152M, 152C, 152B are non-rotatably mounted on the rotary shafts of the output toner transport members 51Y, 51M, 51C, 51B beyond the outer ends of the first member rotating gears 151Y, 151M, 151C, 151B. When the containers 8Y, 8M, 8C, 8B, which is to say, the toner container main bodies 8Ya, 8Ma, 8Ca, 8Ba, are mounted on the color printer main body 11, these coupling gears 152Y, 152M, 152C, 152B are non-rotatably connected with the container coupling gears 88Y, 88M, 88C, 88B.

The biasing members 153Y, 153M, 153C, 153B, for example, coil springs, are disposed around the rotary shafts of the output toner transport members 51Y, 51M, 51C, 51B, between the first member rotating gears 151Y, 151M, 151C, 151B and the coupling gears 152Y, 152M, 152C, 152B, so as to bias the coupling gears 152Y, 152M, 152C, 152B in the axial direction, outward from the first member rotating gears 151Y, 151M, 151C, 151B. Consequently, the coupling gears 152Y, 152M, 152C, 152B and the container coupling gears 88Y, 88M, 88C, 88B are reliably connected.

The first output units 52Y, 52M, 52C, 52B are openings for outputting toner that has been transported by the output toner transport members 51Y, 51M, 51C, 51B, from the transported toner holding unit main bodies 50Y, 50M, 50C, 50B, to the toner resupply pipes. The first output units 52Y, 52M, 52C, 52B are formed on the lateral faces, in the direction of toner transport, of the transported toner holding unit main bodies 50Y, 50M, 50C, 50B. Here, the first output unit 52B of the black toner container main body 8Ba is disposed on the adjacent toner container main body side, which is to say, on the cyan toner container main body 8Ca side.

5. Drive Power Transmission Mechanism

As shown in FIG. 6, the drive power transmission mechanism 30 comprises a housing 130, a connecting member 131, a shaft member 132, a shaft member drive mechanism (first transmission mechanism) 133, and a resupply mechanism drive mechanism (second transmission mechanism) 134. The housing 130 is mounted on the color printer main body 11. The housing 130 is mounted on the color printer main body 11, so that the shaft member 132 crosses the rotary shafts of the output toner transport members 51Y, 51M, 51C, 51B. Here, the housing 130 is mounted on the color printer main body 11, so that, from among the juxtaposed toner container main bodies 8Ya, 8Ma, 8Ca, 8Ba, it is adjacent to the black container main body 8Ba.

The connecting member 131 is connected to a drive means, for example, a drive motor (not shown). This connecting member 131 comprises a shaft 131*a*, a first transmission gear 131*b*, which is non-rotatably mounted on the shaft 131*a*, and a second transmission gear 131*c*, which is non-rotatably mounted on the shaft 131*a*, at a predetermined distance from the first transmission gear 131*b*.

The shaft member 132 comprises a shaft 132*a*, a rack 132*b*, a shaft rotating gear 132*c*, and a plurality of shaft gears (first gears) 132*d*, 132*e*, 132*f*. The shaft 132*a* is mounted in the housing so as be axially rotatable, and mobile in the axial direction. The rack 132*b* is mounted on the shaft 132*a* so as to be rotatable with respect to the shaft 132*a*, and immobile in the axial direction with respect to the shaft 132*a*. The rack 132*b* comprises teeth 132*g* and a protrusion 132*h*. The teeth 132*g* are provided so as to face away from the shaft 132*a*, which is to say, so as to protrude in the direction of the connecting member 131. The protrusion 132*h* is provided substantially parallel to the axial direction of the shaft 132*a*. Here, the protrusion 132*h* is provided so that the protrusion 132*h* is substantially parallel to the axial direction of the shaft 132*a*, and so as to protrude from the housing to the exterior, from a first transmission gear series 133*b* side, of the shaft member drive mechanism (first transmission mechanism) 133, which is described hereinbelow, when the shaft member 132 is mounted in the housing 130. The shaft rotating gear 132*c* is mounted non-rotatably on the shaft 132*a*.

A plurality of shaft gears, for example, a total of three shaft gears, which are the first to the third shaft gears, 132*d*, 132*e*, 132*f*, are mounted non-rotatably on the shaft at intervals. Here, the first through the third shaft gears 132*d*, 132*e*, 132*f* are mounted non-rotatably on the shaft 132*a* at intervals, in the order of first shaft gear 132*d*, second shaft gear 132*e*, and third shaft gear 132*f*, in the direction moving away from the housing 130. These first through third shaft gears 132*d*, 132*e*, 132*f* are first helical gears.

The shaft member drive mechanism (first transmission mechanism) 133 serves to transmit the drive power of the drive motor from the connecting member 131 to the shaft member 132, so as to move the shaft member 132 in the axial direction. The shaft member drive mechanism (first transmission mechanism) 133 is mounted on the housing 130 between the connecting member 131 and the shaft member 132.

The shaft member drive mechanism (first transmission mechanism) 133 comprises a first clutch 133*a*, the first transmission gear series 133*b*, a transmission gear shaft 133*c*, and a worm gear 133*d*. The first clutch 133*a* comprises a third transmission gear 134*e*, which meshes with the first transmission gear that is mounted on the connecting member 131, and can be switched between a state in which it transmits the drive power from the connecting member 131 and a state in which it does not transmit the drive power from the connecting member 131. The first transmission gear series 133*b* serves to transmit drive power from the first clutch 133*a* to the shaft member 132, and comprises a plurality of intermeshing gears.

These plural gears in the first transmission gear series 133*b* are mounted in juxtaposition in a direction orthogonal to the axial direction of the shaft member 132 on one lateral face of the housing 130. The transmission gear shaft 133*c* is mounted non-rotatably on the output side gear of the first transmission gear series 133*b*. The worm gear 133*d* is mounted non-rotatably on the transmission gear shaft 133*c*, and meshes with the teeth 132*g* of the rack 132*b*. Consequently, when the worm gear 133*d* that is meshed with the teeth 132*g* of the rack 132*b* rotates, the rack 132*b* can be moved in the axial direction of the shaft member 132 in conjunction with the rotation of the worm gear 133*d*. Furthermore, when any one of the first through third shaft gears 132*d*, 132*e*, 132*f* meshes with any one of the first member rotating gears 151Y, M, C, B and rotates, even if thrust force is generated in the shaft 132*a*, because the teeth 132*g* of the rack 132*b* are meshed with the worm gear 133*d*, the rack 132*b* does not move in the axial direction of the shaft 132*a* due to the meshing force between the teeth 132*g* of the rack 132*b* and the worm gear 133*d*.

The resupply mechanism drive mechanism (second transmission mechanism) 134 serves to transmit the drive power of the drive motor from the connecting member 131 to the shaft member 132 so as to rotate the shaft member 132. The resupply mechanism drive mechanism (second transmission mechanism) 134 is mounted on the housing 130, between the connecting member 131 and the shaft member 132.

The resupply mechanism drive mechanism (second transmission mechanism) 134 comprises a second clutch 134*a* and a second transmission gear series 134*b*. The second clutch 134*a* comprises a fourth transmission gear 134*c* that meshes with the second transmission gear 131*c*, which is mounted on the connecting member 131, and can be switched between a state in which it transmits the drive power from the connecting member 131 and a state in which it does not transmit the drive power from the connecting member 131. The second transmission gear series 134*b* serves to transmit the drive power from the second clutch 134*a* to the shaft member 132 side, and comprises a plurality of intermeshing gears. This plurality of gears in the second transmission gear series 134*b* are mounted in juxtaposition in the direction orthogonal to the axial direction of the shaft member 132, on the lateral face that faces the aforementioned lateral face of the housing 130. The output side gear of the second transmission gear series 134*b* meshes with a shaft rotating gear 132*c* on the shaft member 132. This shaft rotating gear 132*c* is formed so as to be elongated in the axial direction, so that, when the shaft member 132 moves in the axial direction, it is always meshed with the output side gear of the second transmission gear series 134*b*. Consequently, when the second transmission gear series 134*b* rotates, the shaft member 132 rotates together with the shaft rotating gear 132*c*, which is meshed with the output side gear of the second transmission gear series 134*b*, in conjunction with the rotation of the second transmission gear series 134*b*.

With such a drive power transmission mechanism 30, if the shaft member 132 is moved in the axial direction by way of the drive power that is transmitted to the shaft member 132 by the shaft member drive mechanism (first transmission mechanism) 133, any one of the first through third shaft gears 132*d*, 132*e*, 132*f* meshes with any one of the first member rotating gears 151Y, 151M, 151C, 151B of the output toner transport members 51Y, 51M, 51C, 51B that is to be driven. Then, if the shaft member 132 is rotated by way of the drive power that is transmitted to the shaft member 132 by the resupply mechanism drive mechanism (second transmission mechanism), any one of the output toner transport members 51Y, 51M, 51C, 51B can be rotated.

6. Movement Detection Sensor

The movement detection sensor 31 serves to detect the movement of the shaft member 132. The movement detection sensor 31 is mounted on the color printer main body 11 at a predetermined distance from the lateral face of the housing 130 on which the first transmission gear series 133*b* is mounted. The movement detection sensor 31 comprises two sensor units 31*a*. The two sensor units 31*a* are disposed facing each other over a predetermined distance. The tip of the protrusion 132*h* on the rack 132*b* can be interposed and removed from between these two sensor units 31*a*. Here, when the rack 132*b* of the shaft member 132 is at the position that is furthest from the toner container 8, the protrusion 132*h* on the rack 132*b* is positioned between the two sensor units 31*a*. The situation when the protrusion 132*h* on the rack 132*b* is positioned between the two sensor units 31*a* is defined as the home position for the shaft member 132. If the shaft member 132 moves from the home position in the direction of the toner container 8, the protrusion 132*h* on the rack 132*b* is removed from between the two sensor units 31*a*. Thus, when the protrusion 132*h* on the rack 132*b* is removed from between the two sensor units 31*a*, the sensor units 31*a* of the movement detection sensor 31 detect that the shaft member 132 has moved.

Note that the shaft member 132 is normally located in the home position and, from among the first through third shaft gears 132*d*, 132*e*, 132*f*, the first shaft gear 132*d*, which is located closest to the housing 130 side, meshes with the first member rotating gear 151B on the black output toner transport member 51B.

7. Control Unit

The control unit controls the drive motor, the first clutch 133*a* and the second clutch 134*a*. This control unit controls the amount of movement of the shaft member 132 and the amount of rotation of the shaft member 132 by way of the drive power transmission mechanism 30, and switches the first clutch 133*a* and the second clutch 134*a* ON and OFF.

For example, if black toner is to be transported, because the shaft member 132 is normally in the home position, the control unit sets the first clutch 133*a* to OFF and sets the second clutch 134*a* to ON, so that the shaft member 132, which is to say, the first shaft gear 132*d*, which has meshed with the first member rotating gear 151B of the black output toner transport member 51B, is rotated by a predetermined amount.

For example, if yellow toner is to be transported, the control unit sets the first clutch 133*a* to ON and the second clutch 134*a* to OFF, and moves the shaft member 132 by a predetermined amount, so as to mesh the first member rotating gear 151Y of the yellow output toner transport member 51Y with the third shaft gear 132*f* on the shaft member 132. Then, the control unit sets the first clutch 133*a* to OFF and the second clutch 134*a* to ON, so as to rotate the third shaft gear 132*f* on the shaft member 132, which is meshed with the first member rotating gear 151Y of the yellow output toner transport member 51Y, by a predetermined amount.

For example, if magenta toner is to be transported, the control unit sets the first clutch 133*a* to ON and the second clutch 134*a* to OFF and moves the shaft member 132 by a predetermined amount, so as to mesh the second shaft gear 132*e* on the shaft member 132 with the first member rotating gear 151M of the magenta output toner transport member 51M. Then, the control unit sets the first clutch 133*a* to OFF and the second clutch 134*a* to ON, and rotates the second shaft gear 132*e* on the shaft member 132, which is meshed with the first member rotating gear 151M of the magenta output toner transport member 51M, by a predetermined amount.

For example, if cyan toner is to be transported, the control unit sets the first clutch 133*a* to ON and the second clutch 134*a* to OFF and moves the shaft member 132 by a predetermined amount, so as to mesh the first shaft gear 132*d* on the shaft member 132 with the first member rotating gear 151C of the cyan output toner transport member 51C Then, the control unit sets the first clutch 133*a* to OFF and the second clutch 134*a* to ON and rotates the first shaft gear 132*d* on the shaft member 132, which is meshed with the first member rotating gear 151C of the cyan output toner transport member 51C, by a predetermined amount.

Thus, by moving the shaft member 132 and rotating the shaft gears 132*d*, 132*f*, 132*e* on the shaft member by predetermined amounts, the first member rotating gears 151Y, 151M, 151C, 151B, which are meshed with the shaft gears 132*d*, 132*f*, 132*e*, are rotated. Thereupon, the output toner transport members 51Y, 51M, 51C, 51B are rotated and the various colors of toner are transported to the first output units 52Y, 52M, 52C, 52B.

Furthermore, if the output toner transport members 51Y, 51M, 51C, 51B are rotated, the container coupling gears 88Y, 88M, 88C, 88B, which are connected to the coupling gears 152Y, 152M, 152C, 152B of the output toner transport members 51Y, 51M, 51C, 51B, rotate, and the first intermediate gears 86Y, 86M, 86C, 86B rotate. Thereupon, the second intermediate gear 87B and the second member rotating gears 182Y, 182M, 182C, 182B, which are meshed with the first intermediate gears 86Y, 86M, 86C, 86B, rotate. Then, the toner stirring members 81Y, 81M, 81C, 81B, which correspond to the third member rotating gear 181B, which is messed with the second intermediate gear 87B, and the third member rotating gears 181Y, 181M, 181C, which are meshed with the first intermediate gears 86Y, 86M, 86C, as well as the toner transport members 82Y, 82M, 82C, 82B, which correspond to the second member rotating gears 182Y, 182M, 182C, 182B, rotate.

Consequently, the toner that is held in the toner container main bodies 8Ya, 8Ma, 8Ca, 8Ba is stirred and transported towards the second output units 80Yc, 80Mc, 80Cc, 80Bc.

Thus, by meshing the shaft gears 132*d*, 132*f*, 132*e* on the shaft member with the first member rotating gears 151Y, 151M, 151C, 151B and rotating, it is possible to rotate the toner stirring members 81Y, 81M, 81C, 81B, the output toner transport members 51Y, 51M, 51C, 51B, and the toner transport members 82Y, 82M, 82C, 82B, so as to transport the various toners from the toner container main bodies 8Ya, 8Ma, 8Ca, 8Ba to the toner transport units 80Yb, 80Mb, 80Cb, 80Bb to be transported in the direction of the first output units 52Y, 52M, 52C, 52B, in the toner transport units 80Yb, 80Mb, 80Cb, 80Bb.

Note that, after transporting the various colors of toner, the control unit sets the first clutch 133*a* to ON and the second clutch 134*a* to OFF and returns the shaft member 132 to the home position.

Meanwhile, if the various colors of toner are to be continuously transported, first the control unit sets the first clutch 133*a* to OFF and set the second clutch 134*a* to ON and rotates the shaft member 132, which is in the home position, which is to say, the first shaft gear 132*d*, which is meshed with first member rotating gear 151B of the black output toner transport member 51B, by a predetermined amount.

Then, the control unit sets the first clutch 133*a* to ON and the second clutch 134*a* to OFF, and moves the shaft member 132 by a predetermined amount so as to mesh the third shaft gear 132*f* on the shaft member 132 with the first member rotating gear 151Y of the yellow output toner transport member 51Y. Then, the control unit sets the first clutch 133*a* to OFF and the second clutch 134*a* to ON, and rotates the third shaft gear 132*f* on the shaft member 132, which is meshed with the first member rotating gear 151Y of the yellow output toner transport member 51Y, by a predetermined amount.

Then, the control unit sets the first clutch 133*a* to ON and the second clutch 134*a* to OFF, and moves the shaft member 132 by a predetermined amount so as to mesh the second shaft gear 132*e* on the shaft member 132 with the first member rotating gear 151M of the magenta output toner transport member 51M.

Then, the control unit sets the first clutch 133*a* to OFF and the second clutch 134*a* to ON, and rotates the second shaft gear 132*e* on the shaft member 132, which is meshed with the first member rotating gear 151M of the magenta output toner transport member 51M, by a predetermined amount. Lastly, the control unit sets the first clutch 133*a* to ON and the second clutch 134*a* to OFF, and moves the shaft member 132 by a predetermined amount so as to mesh the first shaft gear 132*d* on the shaft member 132 with the first member rotating gear 151C of the cyan output toner transport member 51C. Then, the control unit sets the first clutch 133*a* to OFF and the second clutch 134*a* to ON, and rotates the first shaft gear 132*d* on the shaft member 132, which is meshed with the first member rotating gear 151C of the cyan output toner transport member 51C, by a predetermined amount.

If the shaft member 132 is incrementally moved in this manner and the shaft gears 132*d*, 132*f*, 132*e* on the shaft member are rotated by predetermined amounts, the first member rotating gears 151Y, 151M, 151C, 151B, which are meshed with the shaft gears 132*d*, 132*f*, 132*e*, are rotated. Thereupon, the output toner transport members 51Y, 51M, 51C, 51B are rotated and the various colors of toner are transported to the first output units 52Y, 52M, 52C, 52B. Furthermore, if the output toner transport members 51Y, 51M, 51C, 51B are rotated, the container coupling gears 88Y, 88M, 88C, 88B, which are connected to the coupling gears 152Y, 152M, 152C, 152B of the output toner transport members 51Y, 51M, 51C, 51B, rotate and the first intermediate gears 86Y, 86M, 86C, 86B rotate. Thereupon, the second intermediate gears 87Y, 87M, 87C, 87B and the second member rotating gears 182Y, 182M, 182C, 182B, which are meshed with the first intermediate gears 86Y, 86M, 86C, 86B, rotate, and the toner stirring members 81Y, 81M, 81C, 81B, which comprise the third member rotating gears 181Y, 181M, 181C, 181B that are meshed with the second intermediate gears 87Y, 87M, 87C, 87B, and the toner transport members 82Y, 82M, 82C, 82B, which comprise the second member rotating gears 182Y, 182M, 182C, 182B, rotate. Consequently, the toner that is held in the toner container main bodies 8Ya, 8Ma, 8Ca, 8Ba is stirred and transported towards the second output units 80Yc, 80Mc, 80Cc, 80Bc.

Thus, by successively meshing the shaft gears 132*d*, 132*f*, 132*e* on the shaft member with the first member rotating gears 151Y, 151M, 151C, 151B and rotating, it is possible to rotate the toner stirring members 81Y, 81M, 81C, 81B, the output toner transport members 51Y, 51M, 51C, 51B, and the toner transport members 82Y, 82M, 82C, 82B, so as to transport the various toners from the toner container main bodies 8Ya, 8Ma, 8Ca, 8Ba to the toner transport units 80Yb, 80Mb, 80Cb, 80Bb to be transported in the direction of the first output units 52Y, 52M, 52C, 52B in the toner transport units 80Yb, 80Mb, 80Cb, 80Bb.

Note that after continuously transporting the various colors of toner, the control unit sets the first clutch 133*a* to ON and the second clutch 134*a* to OFF, and returns the shaft member 132 to the home position.

8. Toner Resupply Pipes

A plurality of toner resupply pipes 13, for example, four toner resupply pipes 13, each comprise a toner resupply tube 13*a*. Each of the four toner resupply pipes 13 are connected to the corresponding first output units 52Y, 52M, 52C, 52B, by way of one of the toner resupply tubes 13*a*. These four toner resupply pipes 13 are juxtaposed in the direction of the rotary shaft 41 of the rotary development device 4, between the toner container 8 and the rotary development device 4. Furthermore, the four toner resupply pipes 13 are disposed between the laser unit 12 and the photosensitive drum 1.

The four toner resupply pipes 13Y, 13M, 13C, 13B resupply the various colors of toner to the rotary development device 4, by insertion into the rotary development device 4, at predetermined rotational positions of the rotary development device 4. For example, the toner resupply pipe 13Y that is mounted on the first output unit 52Y, by way of the toner resupply tube 13*a*, resupplies yellow toner to a yellow developer 4Y of the rotary development device 4, as described hereafter. The toner resupply pipe 13M that is mounted on the first output unit 52M, by way of the toner resupply tube 13*a*, resupplies magenta toner to a magenta developer 4M of the rotary development device 4, as described hereafter. The toner resupply pipe 13C that is mounted on the first output unit 52C, by way of the toner resupply tube 13*a*, resupplies cyan toner to a cyan developer 4C of the rotary development device 4, as described hereafter. The toner resupply pipe 13B that is mounted on the first output unit 52B, by way of the toner resupply tube 13*a*, resupplies black toner to a black developer 4B of the rotary development device 4, as described hereafter.

The rotary development device 4 is a device for supplying toner to the surface of the photosensitive drum 1, on which an electrostatic latent image has been formed so as to form a toner image on the photosensitive drum 1. The rotary development device 4 is rotatably mounted within the color printer main body 11. This rotary development device 4 comprises a rotary rack 40 and the plurality of developers 4Y, 4M, 4C, 4B.

The rotary rack 40 comprises the rotary shaft 41 and is rotatably mounted on the color printer main body 11 by way of this rotary shaft 41. While rotating around the rotary shaft 41, as a result of rotation means not shown in the drawing, the rotary rack 40 successively displaces the plurality of developers 4Y, 4M, 4C, 4B to developing positions facing the photosensitive drum 1.

The four developers 4Y, 4M, 4C, 4B are adjacently disposed around the rotary shaft 41, and supported by the rotary rack 40. Here, the yellow developer 4Y, the magenta developer 4M, the cyan developer 4C and the black developer 4B are disposed one after another in the circumferential direction around the rotary rack 40, which is to say, around the rotary shaft 41, in the 4Y, 4M, 4C, 4B order, and supported by the rotary rack 40. These four developers 4Y, 4M, 4C, 4B are disposed at intervals of approximately 90 degrees in the circumferential direction.

As shown in FIG. 1, each of the four developers 4Y, 4M, 4C, 4B comprise a developer main body 4*a*, a developer toner stirring member 4*b*, a developer roller 4*c*, and a toner supply roller 4*d*

The developer toner stirring member 4*b* serves to stir the toner that is held inside the developer main body 4*a*, and is rotatably mounted within the developer main body 4*a*. Here, the developer toner stirring member 4*b* is rotatably mounted within the developer main body 4*a*, on the side that is distant from the photosensitive drum 1 and the developer roller 4*c*, which is to say, on the side of the rotary shaft 41 of the rotary rack 40.

The developer roller 4*c* serves to affix the toner that is held in the developer main body 4*a* on the electrostatic latent image on the surface of the photosensitive drum 1. The developer roller 4*c* comprises a rotary shaft and is rotatably mounted within the developer main body 4*a* by way of this rotary shaft. Here, the developer roller 4*c* is rotatably mounted within the developer main body 4*a*, at the external peripheral face of the rotary rack 40.

The toner supply roller 4*d* serves to supply toner from the developer toner stirring member 4*b* side to the developer roller 4*c* side, and is rotatably mounted within the developer main body 4*a*, between the developer toner stirring member 4*b* and the developer roller 4*c*.

As described above, in the color printer 100, by moving the shaft member 132 in the axial direction, and after moving the shaft member 132, rotating the shaft member 132, it is possible to transmit the drive power of the drive motor to the output toner transport members 51Y, 51M, 51C, 51B, with one drive power transmission mechanism 30. Consequently, it is not necessary to provide a plurality of drive motors, which allows for a reduction in the size of the drive power transmission mechanism 30, and a reduction in the manufacturing costs of the drive power transmission mechanism 30. Furthermore, because housing 130 of the drive power transmission mechanism 30 is mounted on the color printer main body 11 so that the shaft member 132 of the drive power transmission mechanism 30 crosses the rotary shafts of the output toner transport members 51Y, 51M, 51C, 51B, by disposing the drive power transmission mechanism 30 in juxtaposition with a plurality of toner container main bodies 8Ya, 8Ma, 8Ca, 8Ba, it is possible to reduce the dimensions of the color printer main body 11 in one direction (the direction orthogonal to the direction in which the containers are aligned).

In other words, it is possible to reduce the size of the color printer 100.

Furthermore, the teeth 132*g* on the rack 132*b* of the shaft member 132, which mesh with the worm gear 133*d* of the shaft member drive mechanism (first transmission mechanism) move the shaft member 132 in the axial direction in conjunction with the rotation of the worm gear 133*d*. At this time, it is possible to precisely displace the shaft member 132 in the axial direction while reliably meshing the worm gear 133*d* and the rack 132*b*, by way of the thrust force generated in the direction of the rotary shaft of the worm gear 133*d*.

Next, the movement detection sensor detects the movement of the shaft member 132, and the amount of movement and the amount of rotation of the shaft member 132 are controlled by the control unit, whereby it is possible to precisely move the shaft member 132 in the axial direction and to rotate it.

Next, when the shaft member 132 is moved in the axial direction, any one of the plurality of shaft gears 132*d*, 132*e*, 132*f* meshes with the first member rotating gears 151Y, 151M, 151C, 151B of the output toner transport member 51Y, 51M, 51C, 51B that is to be driven, whereby the drive power can be individually transmitted to the output toner transport members 51Y, 51M, 51C, 51B.

Next, the shaft gears 132*d*, 132*e*, 132*f* are first helical gears and the first member rotating gears 151Y, 151M, 151C, 151B are second helical gears, whereby, even though the shaft member 132 crosses the rotary shaft of the output toner transport members 51Y, 51M, 51C, 51B, it is possible to reliably transmit the drive power from the shaft member 132 to the output toner transport members 51Y, 51M, 51C, 51B.

Lastly, the black output toner transport member 51B and the output unit 52B are disposed on the cyan container main body 8Ca side. Consequently, the axial separation between the black output toner transport member 51B and the cyan output toner transport member 51C can be shortened. Consequently, a single shaft gear 132*d* suffices for the meshing gears between the first member rotating gear 151B of the black output toner transport member 51B and the first member rotating gear 151C of the cyan output toner transport member 51C. In other words, it is possible to rotate the output toner transport members 51Y, 51M, 51C, 51B without providing four shaft gears on the shaft 132*a* of the shaft member 132, but only by providing three shaft gears 132*d*, 132*e*, 132*f*. Furthermore, by disposing the black output toner transport member 51B and the output unit 52B on the cyan container main body 8Ca side, even if the black container main body 8Ba has a large volume, the length of the toner supply route for the toner resupply member for supplying toner to the black developer 4B from the black container main body 8Ba can be kept short. In addition, the second shutter opening/closing mechanism 85B of the black container main body 8Ba comprises a third engagement gear 385B that meshes between the second operating member 185B and the second engagement gear 285B, whereby it is possible to make the direction of turning of the second operating member 185B the same as that of the first operating members 185Y, 185M, 185C of the first shutter opening/closing mechanisms 85Y, 85M, 85C, of the other container main bodies 8Ya, 8Ma, 8Ca. In other words, it is possible for the direction of rotation, which is to say, the direction of turning, of the operating members 185Y, 185M, 185C, 185B of all the container main bodies 8Ya, 8Ma, 8Ca, 8Ba to be the same.

Second Embodiment

1. Overview

Figure 9:
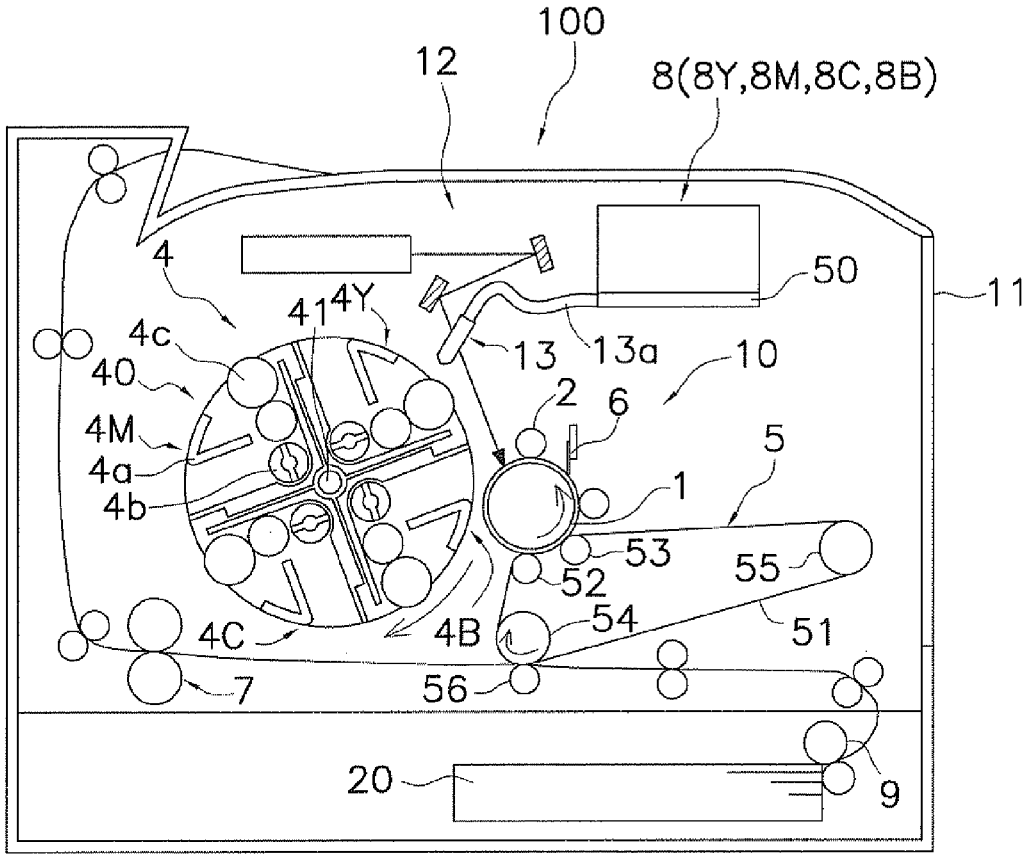
FIG. 9 is a schematic sectional view of a color printer according to a second embodiment of the present invention.
Figure 10:
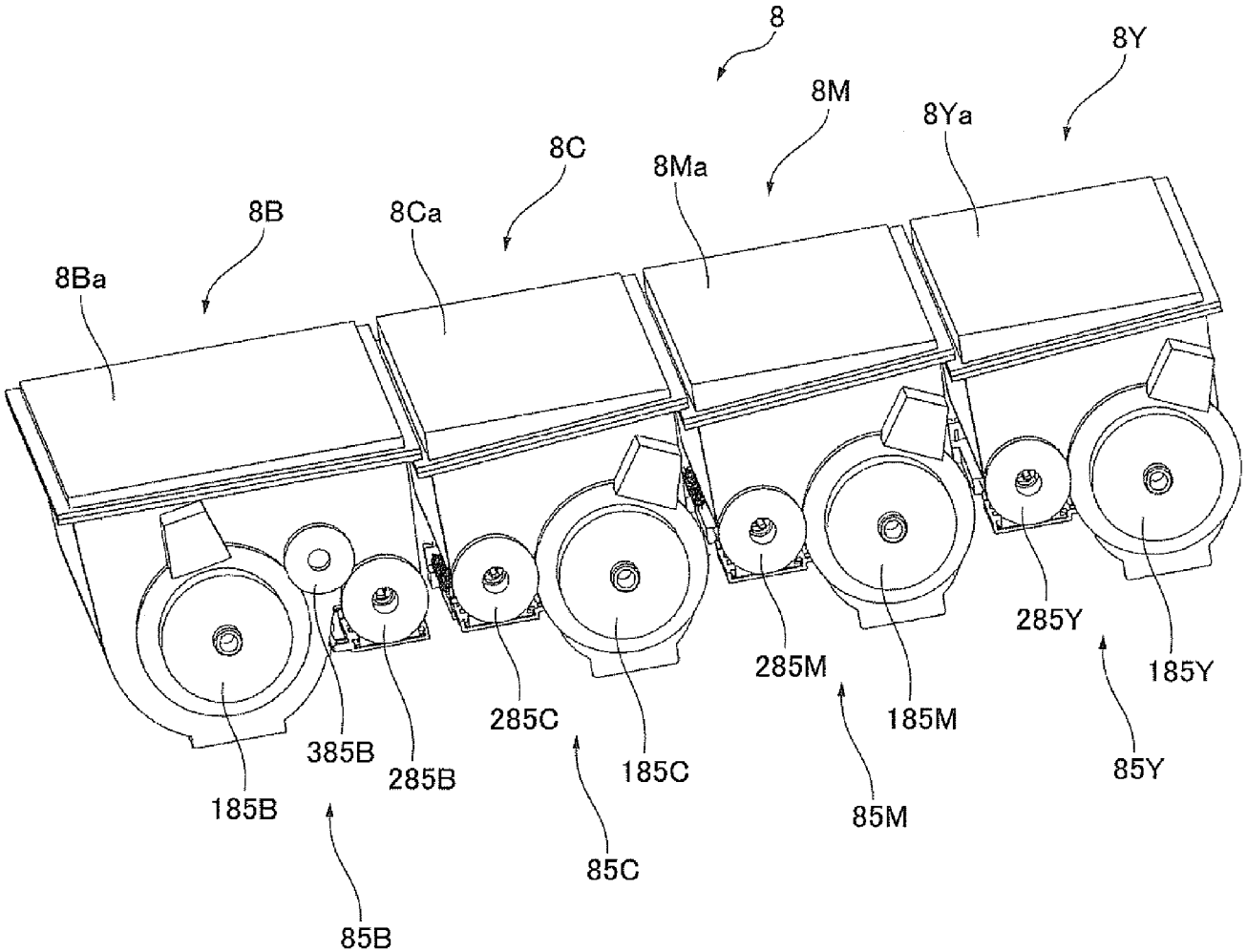
FIG. 10 is an external perspective view of a toner container.
Figure 14:
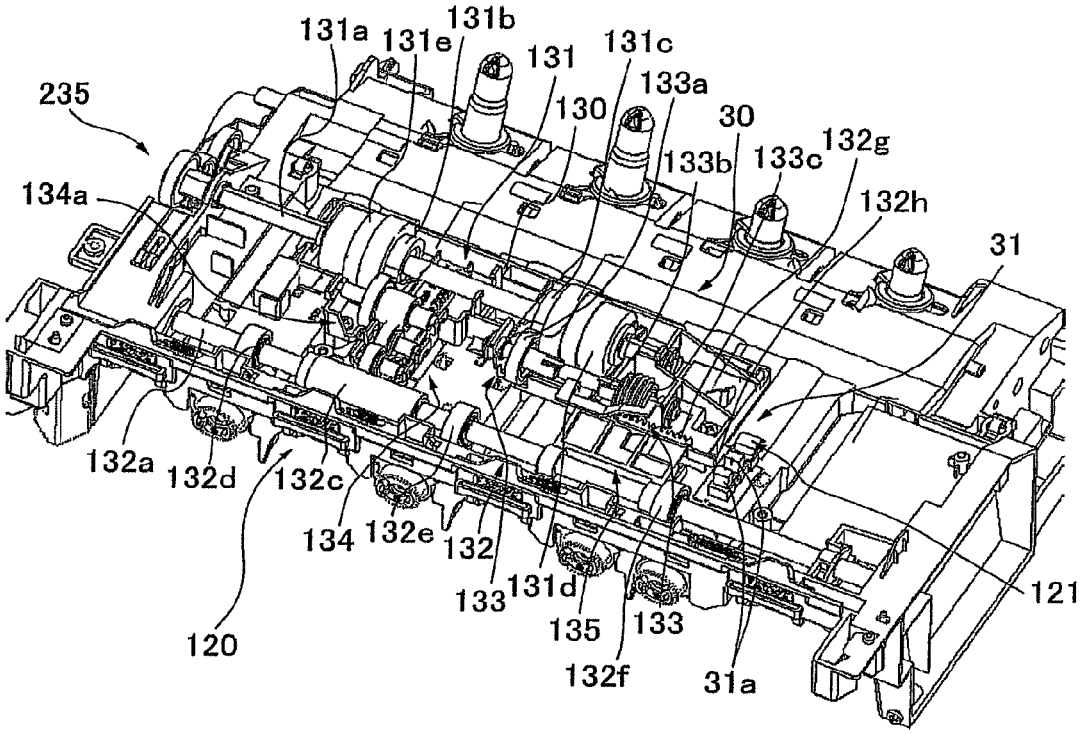
FIG. 14 is a view illustrating a drive power transmission mechanism.
Figure 16:
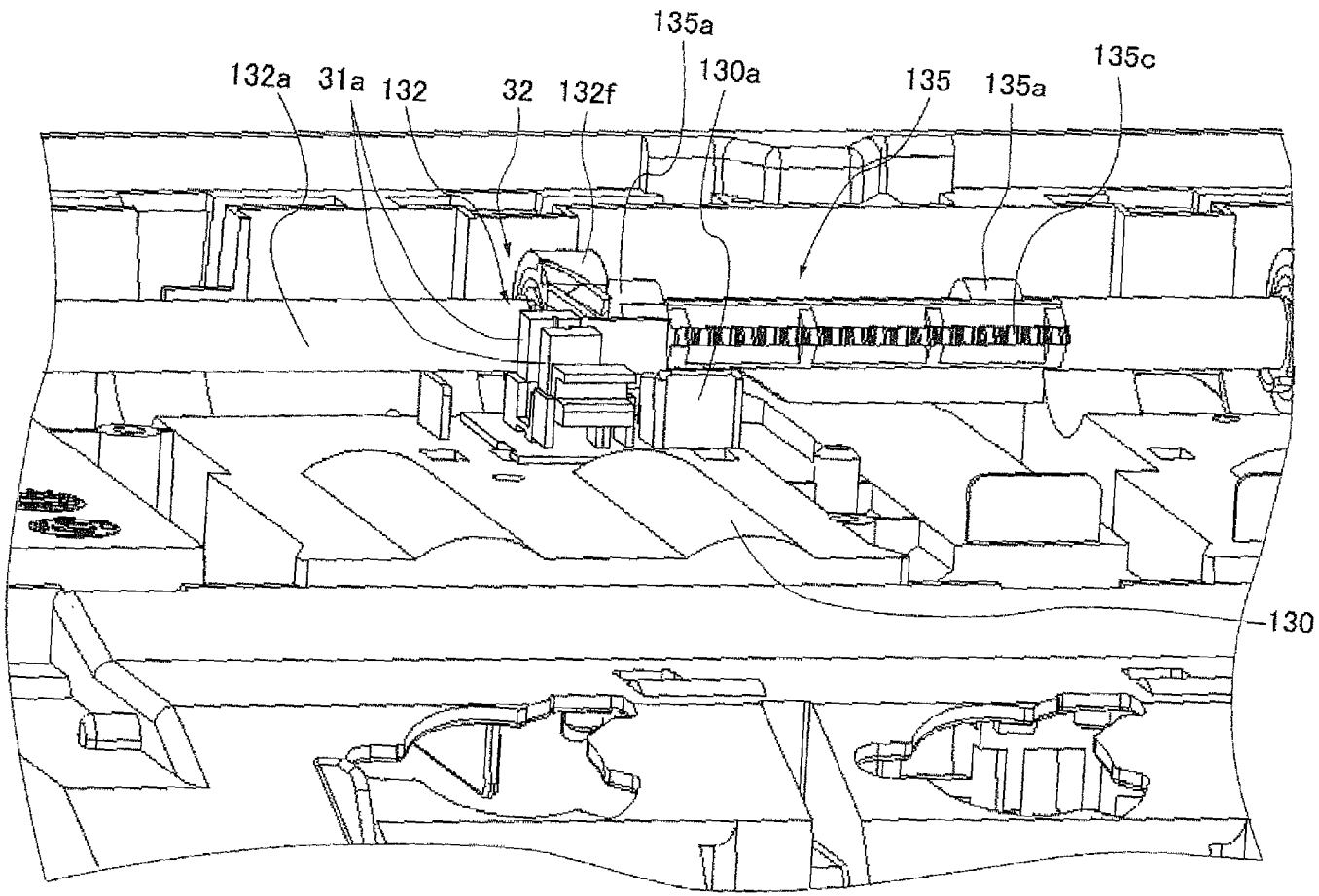
FIG. 16 is a view showing the shaft member 132, the movement detection sensor 31 and the protrusion 130*a*.

FIG. 9 is a drawing schematically illustrating the structure of a color printer to which one mode of embodiment of the present invention has been applied. As shown in FIG. 9, FIG. 14 and FIG. 16, the color printer 100 principally comprises a color printer main body 11 (image forming device main body), an image forming unit 10, a toner container 8, a transported toner holding unit 50, a drive power transmission mechanism 30, a movement detection sensor 31, a movement stopping mechanism 32, a control unit (not shown), and a toner resupply pipe 13. The image forming unit 10 is provided substantially in the center of the color printer main body 11.

2. Image Forming Unit

As shown in FIG. 9, the image forming unit 10 comprises a photosensitive drum 1, a corona unit 2, a rotary development device 4 (development device), a transfer device 5, a cleaning device 6, and a laser unit 12. The corona unit 2, the rotary development device 4, the transfer device 5, the cleaning device 6, and the laser unit 12, are disposed around the photosensitive drum 1. Note that a fixing device 7 is disposed downstream in the direction of paper transport from the photosensitive drum 1. The fixing device 7 is a device for fixing a toner image that has been transferred to a transfer material. Furthermore, a paper supply unit 20 is provided below the image forming unit 10 and a paper supply roller 9 is disposed in the direction of paper supply from the paper supply unit.

The photosensitive drum 1 (image bearing member) is rotatably mounted within the color printer main body 11.

An electrostatic latent image can be formed by the laser unit 12 on the surface of the photosensitive drum 1. The corona unit 2 is a device for uniformly charging the photosensitive drum 1, which is disposed above the photosensitive drum 1.

The transfer device 5 is a device for transferring the toner image on the photosensitive drum 1 to the paper, and comprises an intermediate transfer belt 51, primary transfer rollers 52, 53, a drive roller 55, a secondary transfer counter-roller 54, and a secondary transfer roller 56. The intermediate transfer belt 51 is mounted across each of the primary transfer rollers 52, 53, the drive roller 55, and the secondary transfer counter-roller 54. This intermediate transfer belt 51 travels around the primary transfer rollers 52, 53, the drive roller 55 and the secondary transfer counter-roller 54 by the drive power of the drive roller 55. A toner image that is formed on the photosensitive drum 1 is thus transferred to the intermediate transfer belt 51, which temporarily bears the transferred toner image. The secondary transfer roller 56 is disposed in a position facing the secondary transfer counter-roller 54 at the outer circumferential face of the intermediate transfer belt 51. Secondary transfer of the toner image to the transfer material is performed with this secondary transfer roller 56.

The cleaning device 6 is a device for removing adherents such as remaining toner that has remained on the photosensitive drum 1, and in this color printer 100, a cleaning blade is provided.

The laser unit 12 is mounted within the color printer main body 11. This laser unit 12 forms an electrostatic latent image on the photosensitive drum 1, by scanning the photosensitive drum 1 on the basis of image information processed by a controller (not shown). The laser unit 12 comprises a semiconductor laser, various lenses, a polygon mirror, a mirror rotating motor and the like.

3. Toner Container

The toner container 8 is a container for supplying toner to the rotary development device 4. The toner container 8 comprises a plurality of containers such as a yellow container 8Y, a magenta container 8M, a cyan container 8C and a black container 8B. These containers 8Y, 8M, 8C, 8B are mounted in juxtaposition within the color printer main body 11.

As shown in FIGS. 10 through 13, each of the plurality of toner containers 8Y, 8M, 8C, 8B respectively have a toner container main body 8Ya, 8Ma, 8Ca, 8Ba, a toner stirring member 81Y, 81M, 81C, 81B, a toner transport member 82Y, 82M, 82C, 82B, a shutter member 84Y, 84M, 84C, 84B, and a shutter opening/closing mechanism 85Y, 85M, 85C, 85B.

The plurality of toner container main bodies 8Ya, 8Ma, 8Ca, 8Ba are juxtaposed above the photosensitive drum 1, aligned in the direction of the axis of rotation of the photosensitive drum 1, which is to say, in the direction of a rotary shaft 41 of the rotary development device 4, and mounted within the color printer main body 11. The plurality of toner container main bodies 8Ya, 8Ma, 8Ca, 8Ba have toner stirring units 80Ya, 80Ma, 80Ca, 80Ba, which are spaces for stirring toner, and toner transport units 80Yb, 80Mb, 80Cb, 80Bb, which are spaces for transporting toner. The bottoms of the toner stirring units 80Ya, 80Ma, 80Ca, 80Ba are substantially semicircular in shape. The bottoms of the toner transport units 80Yb, 80Mb, 80Cb, 80Bb are substantially semicircular in shape. Here, the toner transport unit 80Bb of the black toner container main body 8Ba, is formed on the cyan toner container main body 8Ca side.

At the bottom of these toner transport units 80Yb, 80Mb, 80Cb, 80Bb, second output units 80Yc, 80Mc, 80Cc, 80Bc, for example, openings, are formed for outputting toner that is transported by the toner transport members 82Y, 82M, 82C, 82B, which are described below, to the transported toner holding unit 50, for example, transported toner holding unit main bodies 50Y, 50M, 50C, 50B. Here, the second output units 80Yc, 80Mc, 80Cc, 80Bc are formed on the shutter opening/closing mechanisms 85Y, 85M, 85C, 85B side, on the bottoms of the toner transport units 80Yb, 80Mb, 80Cb, 80Bb.

Figure 18:
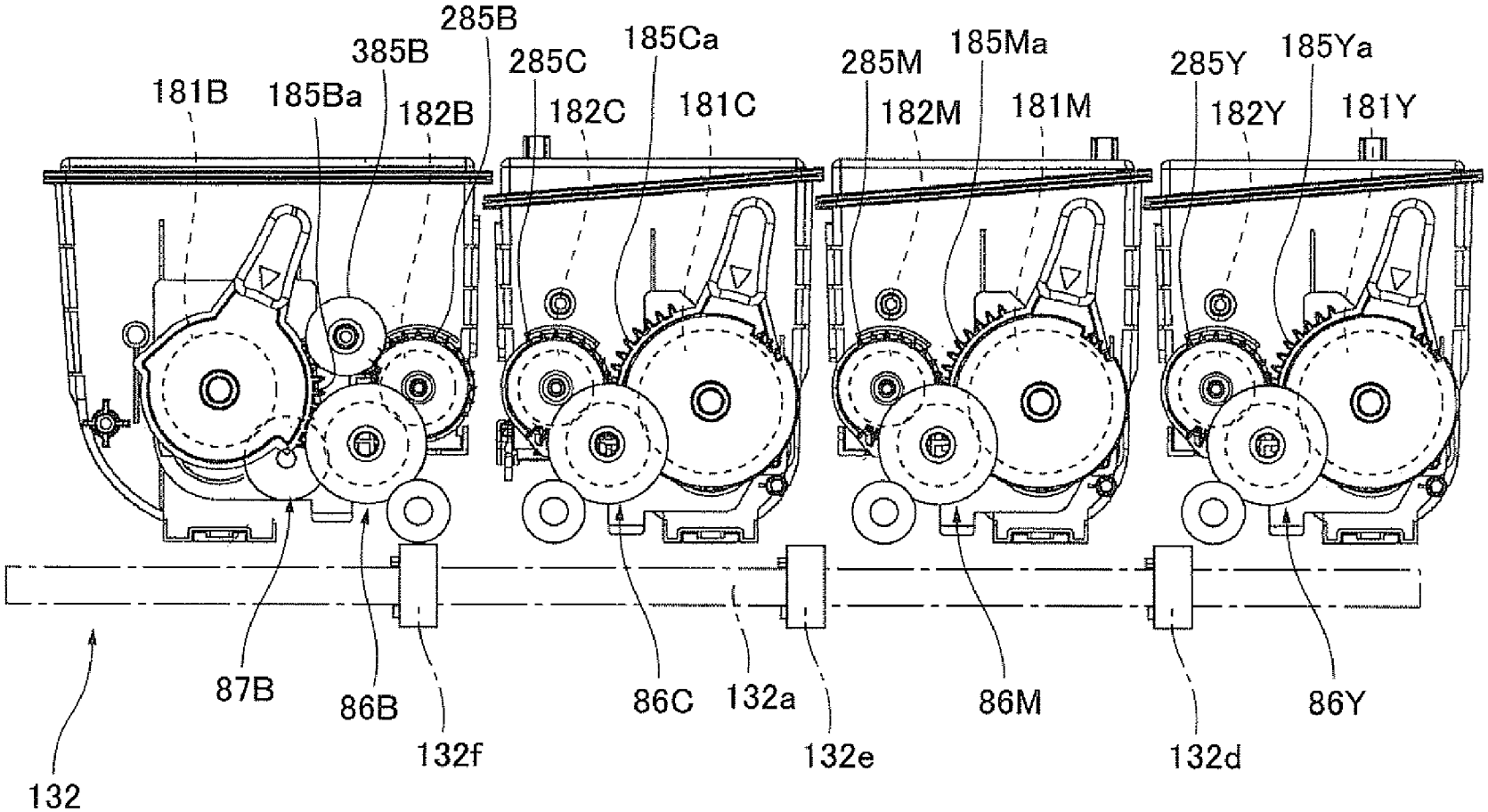
FIG. 18 is a sectional view of the toner container seen from the side facing the aforementioned one side.
Figure 19:
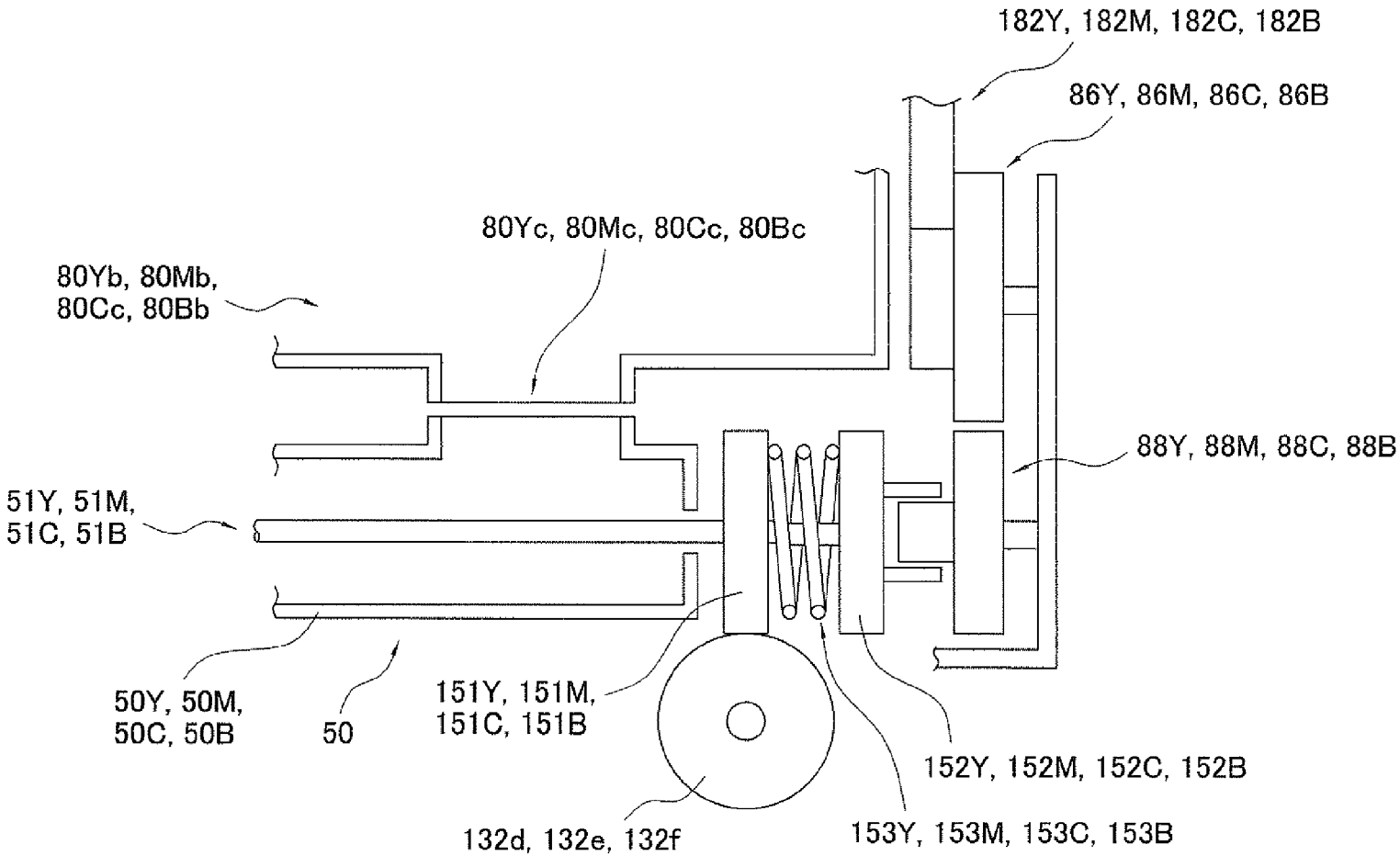
FIG. 19 is an enlarged sectional view of one end of the transported toner holding unit.

Furthermore, as shown in FIG. 18 and FIG. 19, the plurality of toner containers 8Y, 8M, 8C, 8B comprise first intermediate gears 86Y, 86M, 86C, 86B and container coupling gears 88Y, 88M, 88C, 88B. The first intermediate gears 86Y, 86M, 86C, 86B are rotatably mounted on the lateral faces of the toner container main bodies 8Ya, 8Ma, 8Ca, 8Ba on the shutter opening/closing mechanism 85Y, 85M, 85C, 85B side. The first intermediate gears 86Y, 86M, 86C, 86B are two-level gears comprising a large diameter gear and a small diameter gear. The large diameter gears of the first intermediate gears 86Y, 86M, 86C, 86B mesh with the container coupling gears 88Y, 88M, 88C, 88B, which are rotatably mounted on the lateral faces of the toner container main bodies 8Ya, 8Ma, 8Ca, 8Ba below the first intermediate gears 86Y, 86M, 86C, 86B. The small diameter gears of the first intermediate gears 86Y, 86M, 86C, 86B mesh with second member rotating gears 182Y, 182M, 182C, 182B.

Here, the black toner container 8B comprises a second intermediate gear 87B. The second intermediate gear 87B is rotatably mounted on the lateral face of the toner container main body 8Ba, on the shutter opening/closing mechanism 85B side. This second intermediate gear 87B is disposed between the small diameter gear of the first intermediate gear 86B and a third member rotating gear 181B of a toner stirring member 81B, which is described below, and meshes with the small diameter gear of the first intermediate gear 86B and the third member rotating gear 181B.

The toner stirring members 81Y, 81M, 81C, 81B serve to stir the toner that is held in the toner container main bodies 8Ya, 8Ma, 8Ca, 8Ba, and are rotatably mounted within the toner container main bodies 8Ya, 8Ma, 8Ca, 8Ba. Here, the toner stirring members 81Y, 81M, 81C, 81B are rotatably mounted in the toner stirring units 80Ya, 80Ma, 80Ca, 80Ba of the toner container main bodies 8Ya, 8Ma, 8Ca, 8Ba. The toner stirring members 81Y, 81M, 81C, 81B comprise third member rotating gears 181Y, 181M, 181C, 181B which are mounted so as to be non-rotatable around the rotary shafts thereof. The third member rotating gears 181Y, 181M, 181C mesh with the small diameter gears of the first intermediate gears 86Y, 86M, 86C. The third member rotating gear 181B meshes with the second intermediate gear 87B.

The toner transport members 82Y, 82M, 82C, 82B serve to transport the toner that is stirred by the toner stirring members 81Y, 81M, 81C, 81B, and are rotatably mounted within the toner container main bodies 8Ya, 8Ma, 8Ca, 8Ba. Here, the toner transport members 82Y, 82M, 82C, 82B are rotatably mounted in the toner transport units 80Yb, 80Mb, 80Cb, 80Bb of the toner container main bodies 8Ya, 8Ma, 8Ca, 8Ba. Furthermore, the toner transport member 82B of the black toner container main body 8Ba is disposed on the adjacent toner container main body side, which is to say, the cyan toner container main body 8Ca side. Here, the toner transport member 82B of the black toner container main body 8Ba is rotatably mounted in the toner transport unit 80Bb, which is provided on the cyan toner container main body 8Ca side.

The toner transport members 82Y, 82M, 82C, 82B have second member rotating gears 182Y, 182M, 182C, 182B, which are mounted so as to be non-rotatable around the rotary shafts thereof. The second member rotating gears 182Y, 182M, 182C, 182B mesh with the small diameter gears of the first intermediate gears 86Y, 86M, 86C, 86B.

Figure 11:
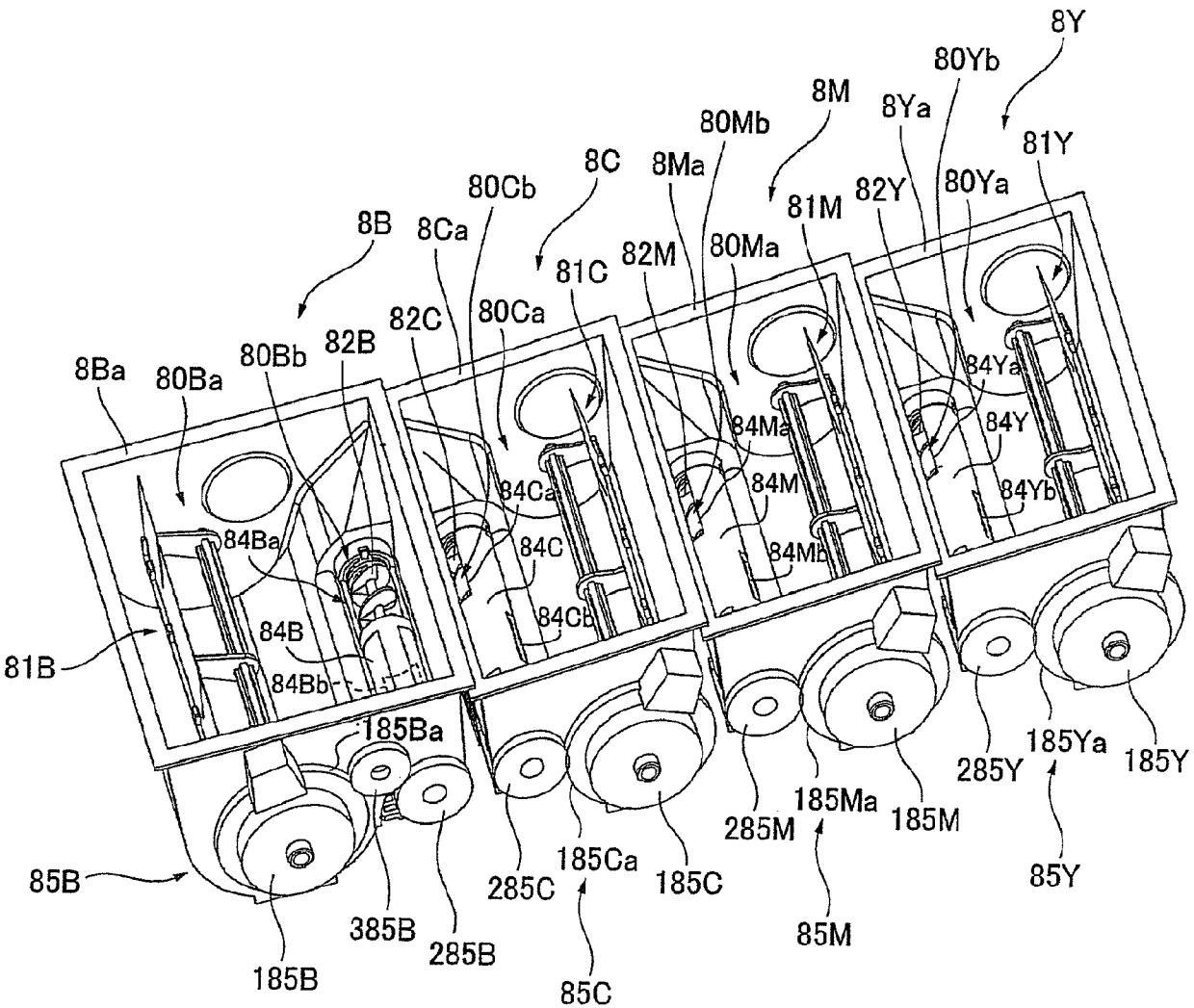
FIG. 11 is a perspective view for describing the interior of the toner container.

As shown in FIG. 11, the shutter members 84Y, 84M, 84C, 84B serve to block toner that is held in the toner container main bodies 8Ya, 8Ma, 8Ca, 8Ba from leaking out from the toner container main bodies 8Ya, 8Ma, 8Ca, 8Ba. The shutter members 84Y, 84M, 84C, 84B are formed as cylinders. The shutter members 84Y, 84M, 84C, 84B comprise first openings 84Ya, 84Ma, 84Ca, 84Ba and second openings 84Yb, 84Mb, 84Cb, 84Bb. These shutter members 84Y, 84M, 84C, 84B are rotatably mounted within the toner transport units 80Yb, 80Mb, 80Cb, 80Bb.

Shutter opening/closing mechanisms 85Y, 85M, 85C, 85B are mounted on the shutter members 84Y, 84M, 84C, 84B and the toner container main bodies 8Ya, 8Ma, 8Ca, 8Ba, in order for the shutter members 84Y, 84M, 84C, 84B to be able to assume an open position and a toner blocking position. In FIG. 11, an example is shown wherein the shutter members 84Y, 84M, 84C are in the toner blocking position, and the shutter member 84B is in the open position.

The shutter opening/closing mechanisms 85Y, 85M, 85C, which are mounted on the toner container main bodies 8Ya, 8Ma, 8Ca, comprise first operating members 185Y, 185M, 185C and first engagement gears 285Y, 285M, 285C. The first operating members 185Y, 185M, 185C operate so as to position the shutter members 84Y, 84M, 84C in the open position or the toner blocking position, and are turnably mounted on the toner container main bodies 8Ya, 8Ma, 8Ca. As shown in FIG. 11 and FIG. 18, these first operating members 185Y, 185M, 185C comprise first gear units 185Ya, 185Ma, 185Ca. First engagement gears 285Y, 285M, 285C are mounted at one end of the shutter members 84Y, 84M, 84C. The teeth of the first engagement gears 285Y, 285M, 285C mesh with the first operating members 185Y, 185M, 185C, which is to say, with the first gear units 185Ya, 185Ma, 185Ca of the first operating members 185Y, 185M, 185C.

With the first shutter opening/closing mechanisms 85Y, 85M, 85C, if the first operating members 185Y, 185M, 185C are turned counterclockwise, the first engagement gears 285Y, 285M, 285C, which mesh with the first gear units 185Ya, 185Ma, 185Ca of the first operating members 185Y, 185M, 185C, rotate clockwise. Thereupon, the shutter members 84Y, 84M, 84C also rotate clockwise so that the shutter members 84Y, 84M, 84C are positioned in the open position. Which is to say, the first openings 84Ya, 84Ma, 84Ca, 84Ba of the shutter members 84Y, 84M, 84C are disposed above the rotary shafts of the shutter members 84Y, 84M, 84C. Thus, the second openings 84Yb, 84Mb, 84Cb, 84Bb of the shutter members 84Y, 84M, 84C are positioned at the location of the second output units 80Yc, 80Mc, 80Cc, 80Bc, which are formed on the bottom faces of the toner transport units 80Yb, 80Mb, 80Cb.

Furthermore, in this situation, if the first operating members 185Y, 185M, 185C are turned clockwise, the first engagement gears 285Y, 285M, 285C, which mesh with the first gear units 185Ya, 185Ma, 185Ca of the first operating members 185Y, 185M, 185C, rotate counterclockwise. Thereupon, the shutter members 84Y, 84M, 84C also rotate counterclockwise, so that the shutter members 84Y, 84M, 84C are positioned in the toner blocking position. Which is to say, the first openings 84Ya, 84Ma, 84Ca, 84Ba of the shutter members 84Y, 84M, 84C are disposed towards the lateral face of the color printer main body 11. Then, the second openings 84Yb, 84Mb, 84Cb, 84Bb of the shutter members 84Y, 84M, 84C are positioned on the side that is distant from the lateral face of the color printer main body 11.

The second shutter opening/closing mechanism 85B, which is mounted on the toner container main body 8Ba, comprises a second operating member 185B, a second engagement gear 285B, and a third engagement gear 385B. The second operating member 185B operates so as to position the shutter member 84B in the open position or the toner blocking position, and is turnably mounted on the toner container main body 8Ba. This second operating member 185B comprises a second gear unit 185Ba. The second engagement gear 285B is mounted on one end of the shutter member 84B.

The third engagement gear 385B is rotatably mounted on the toner container main body 8Ba, between the second operating member 185B and the second engagement gear 285B. This third engagement gear 385B engages with the second operating member 185B, which is to say, the second gear unit 185Ba of the second operating member 185B and the second engagement gear 285B.

With the second shutter opening/closing mechanism 85B, if the second operating member 185B is turned counterclockwise, the third engagement gear 385B, which is engaged with second gear unit 185Ba of the second operating member 185B, rotates clockwise, and the second engagement gear 285B, which is engaged with the third engagement gear 385B, rotates counterclockwise. Thereupon, the shutter member 84B also rotates counterclockwise so that the shutter member 84B is positioned in the open position. In other words, the first opening 84Ba of the shutter member 84B is disposed above the rotary shaft of the shutter member. Thus, the second opening 84Bb of the shutter member 84B is positioned at the location of the second output unit 80Bc, which is formed on the bottom face of the toner transport unit 80Bb.

Furthermore, in this situation, if the second operating member 185B is turned clockwise, the third engagement gear 385B, which meshes with the second gear unit 185Ba of the second operating member 185B, rotates counterclockwise, and the second engagement gear 285B, which meshes with the third engagement gear 385B, rotates clockwise.

Thereupon, the shutter member 84B also rotates clockwise, so as to position the shutter member 84B in the toner blocking position. In other words, the first opening 84Ba of the shutter member 84B is disposed towards the lateral face of the color printer main body 11. Thus, the second opening 84Bb of the shutter member 84B, is disposed on the side that is distant from the lateral face of the color printer main body 11.

4. Transported Toner Holding Unit

Figure 12:
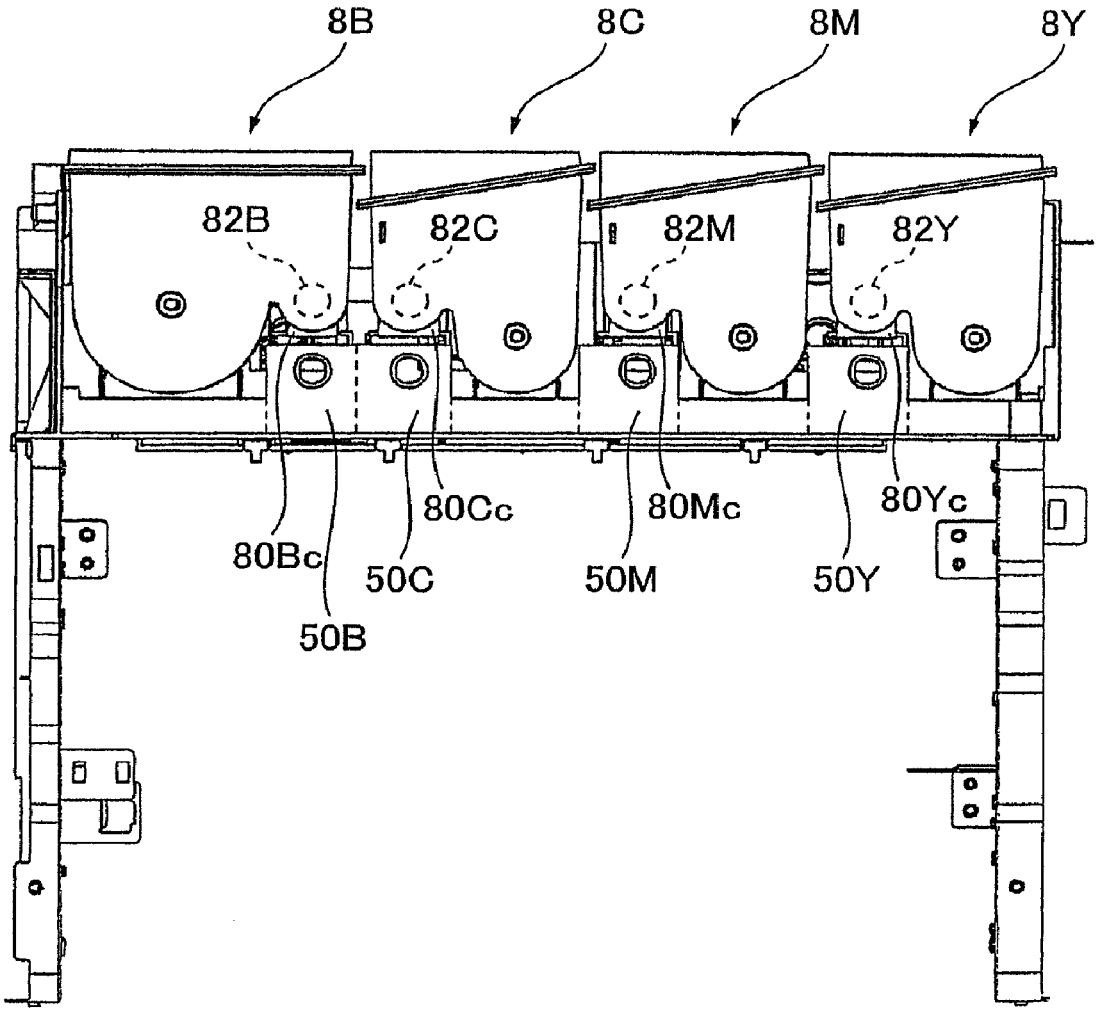
FIG. 12 is a side view seen from one side of the toner container.
Figure 13:
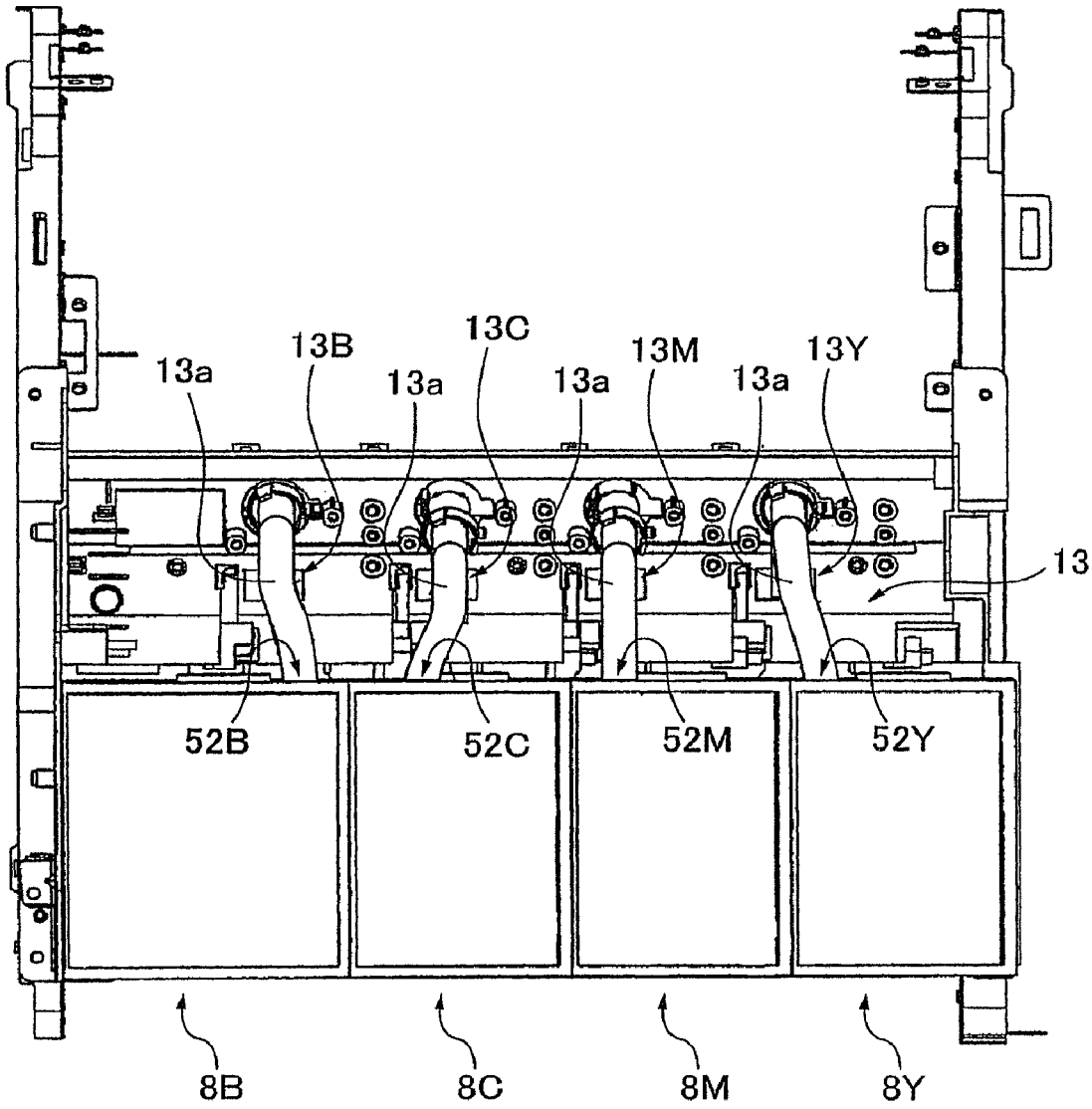
FIG. 13 is a top view seen from the top of the toner container.
Figure 17:
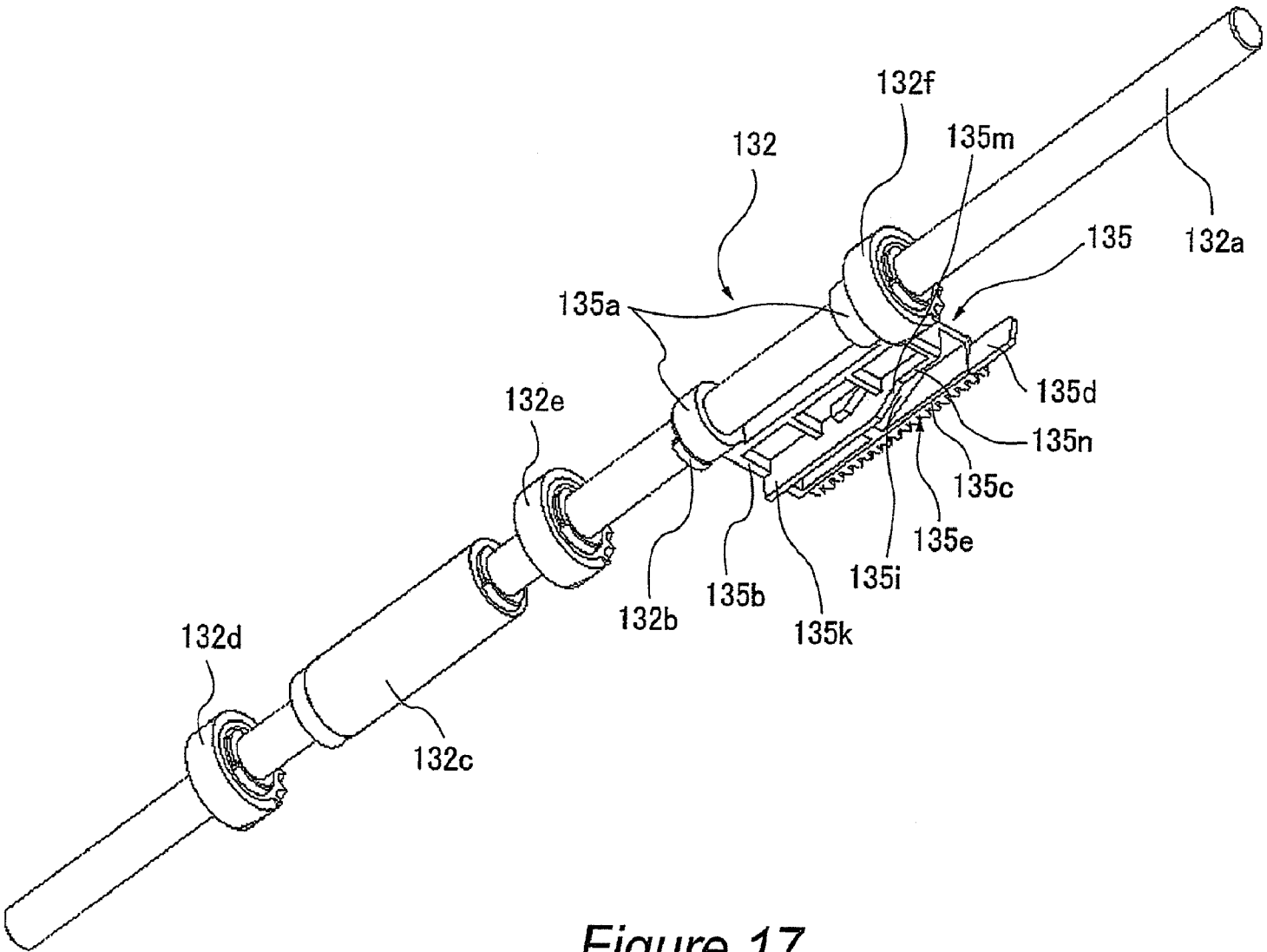
FIG. 17 is a view of the shaft member 132 from the housing 130 side.

As shown in FIG. 9, FIG. 12 and FIG. 17, the transported toner holding unit 50 is provided in the vicinity of the plurality of toner container main bodies 8Ya, 8Ma, 8Ca, 8Ba. Here, the transported toner holding unit 50 is provided below the plurality of toner container main bodies 8Ya, 8Ma, 8Ca, 8Ba, for example, below the place at which the toner transport members 82Y, 82M, 82C, 82B are mounted. The transported toner holding unit 50 comprises transported toner holding unit main bodies 50Y, 50M, 50C, 50B (see FIG. 12), output toner transport members 51Y, 51M, 51C, 51B, and first output units 52Y, 52M, 52C, 52B.

The transported toner holding unit main bodies 50Y, 50M, 50C, 50B are units for holding toner that is transported by the toner transport members 82Y, 82M, 82C, 82B, and are mounted on the color printer main body 11.

The output toner transport members 51Y, 51M, 51C, 51B serve to transport toner that is held in the transported toner holding unit main bodies 50Y, 50M, 50C, 50B, and output it from the transported toner holding unit main body 50, and are rotatably mounted within the transported toner holding unit main bodies 50Y, 50M, 50C, 50B. The output toner transport members 51Y, 51M, 51C, 51B comprise first member rotating gears (second gears) 151Y, 151M, 151C, 151B, coupling gears 152Y, 152M, 152C, 152B, and biasing members 153Y, 153M, 153C, 153B.

The first member rotating gears 151Y, 151M, 151C, 151B (input gears) are non-rotatably mounted on the rotary shaft of the output toner transport members 51Y, 51M, 51C, 51B. The first member rotating gears 151Y, 151M, 151C, 151B are second helical gears, which can mesh with first helical gears (shaft gears, first gears) 132*d*, 132*e*, 132*f*.

The coupling gears 152Y, 152M, 152C, 152B are mounted so as to be non-rotatable around the rotary shafts of the output toner transport members 51Y, 51M, 51C, 51B beyond the outer ends of the first member rotating gears 151Y, 151M, 151C, 151B. When the containers 8Y, 8M, 8C, 8B, which is to say, the toner container main bodies 8Ya, 8Ma, 8Ca, 8Ba, are mounted on the color printer main body 11, these coupling gears 152Y, 152M, 152C, 152B are non-rotatably connected with the container coupling gears 88Y, 88M, 88C, 88B.

The biasing members 153Y, 153M, 153C, 153B, for example, coil springs, are disposed around the rotary shafts of the output toner transport members 51Y, 51M, 51C, 51B, between the first member rotating gears 151Y, 151M, 151C, 151B and the coupling gears 152Y, 152M, 152C, 152B, so as to bias the coupling gears 152Y, 152M, 152C, 152B in the axial direction, outward from the first member rotating gears 151Y, 151M, 151C, 151B.

Consequently, the coupling gears 152Y, 152M, 152C, 152B and the container coupling gears 88Y, 88M, 88C, 88B are reliably connected.

The first output units 52Y, 52M, 52C, 52B are openings for outputting toner that has been transported by the output toner transport members 51Y, 51M, 51C, 51B, from the transported toner holding unit main bodies 50Y, 50M, 50C, 50B, to the toner resupply pipes side. The first output units 52Y, 52M, 52C, 52B are formed on the lateral faces, in the direction of toner transport of the transported toner holding unit main bodies 50Y, 50M, 50C, 50B. Here, the first output unit 52B of the black toner container main body 8Ba is disposed on the adjacent toner container main body side, which is to say, on the cyan toner container main body 8Ca side.

5. Drive Power Transmission Mechanism

As shown in FIG. 14, the drive power transmission mechanism 30 comprises a housing 130, a shaft member 132, a resupply mechanism drive mechanism (second transmission mechanism) 120 and a shaft member drive mechanism (first transmission mechanism) 121.

The housing 130 is mounted on the color printer main body 11. The housing 130 is mounted on the color printer main body 11, so that the shaft member 132 (mobile member) crosses the rotary shafts of the output toner transport members 51Y, 51M, 51C, 51B. Here, the housing 130 is mounted on the color printer main body 11, so that, from among the juxtaposed toner container main bodies 8Ya, 8Ma, 8Ca, 8Ba, it is adjacent to the black container main body 8Ba.

The shaft member 132 comprises a shaft 132*a*, a rack 135, a shaft rotating gear 132*c*, and a plurality of shaft gears (drive gears) 132*d*, 132*e*, 132*f*.

The shaft 132*a* is mounted in the housing so as be axially rotatable, and mobile in the axial direction.

The rack 135 comprises connecting unit 135*a*, a planar unit 135*b*, teeth 135*c* and a protrusion 135*d*. The connecting unit 135*a* is mounted on the shaft 132*a*, and comprises a pair of tubular units that are provided on the shaft 132*a* with a predetermined distance therebetween. Furthermore, as shown in FIG. 17, a shaft gear 132*f* is disposed at one end of the connecting unit 135*a*, and a movement limiting unit 132*b* is provided on the shaft 132*a*, abutting the other end thereof. Consequently, movement thereof in the axial direction of shaft 132*a* is limited. Here, FIG. 17 is a drawing illustrating the shaft member 132, which shows the shaft member 132 as seen from the housing 130 side. Furthermore, the connecting unit 135*a* is mounted so as to be relatively rotatable with respect to the shaft 132*a*. The planar unit 135*b* is a unit that extends from the connecting unit 135*a* on the opposite side to that of the shaft 132*a*, which rotates around the shaft 132*a* in accordance with the relative rotation of the connecting unit 135*a* with respect to the shaft 132*a*. The planar unit 135*b* is a planar unit that extends in the axial direction, and a groove 135*e* is formed on the housing 130 side. An inclined face 1351, which is inclined so that the thickness of the planar unit 135*b* gradually decreases in the lengthwise direction from approximately the center thereof, is formed on the bottom face of this groove 135*e*. The inclined face 1351 is formed in the groove 135*e* on the planar unit 135*b* of the rack 135. Furthermore, a wall 135*k* is formed along the groove 135*e*, at the side of the groove 135*e*. This wall 135*k* is such that an inclination 135*m* is formed parallel to the inclined face 1351, and a level face 135*n* is formed parallel to the planar unit 135*b*, on the section that is adjacent to this inclination 135*m*. The teeth 135*c* are provided at the opposite end from the end at which the connecting unit 135*a* of the planar unit 135*b* is disposed, and protrude in the direction facing away from the shaft 132*a*. The protrusion 135*d* is provided substantially parallel to the axial direction of the shaft 132*a*. Here, as shown in FIG. 17, the protrusion 135*d* is provided so as to protrude substantially parallel to the axial direction of the shaft 132*a*, to the right side when the shaft member 132 is mounted in the housing 130.

The shaft rotating gear 132*c* is mounted non-rotatably on the shaft 132*a*.

A plurality of shaft gears, for example, a total of three shaft gears, which are the first to the third shaft gears, 132*d*, 132*e*, 132*f*, are mounted non-rotatably on the shaft 132*a* at intervals.

Here, the first through the third shaft gears 132*d*, 132*e*, 132*f* are mounted non-rotatably on the shaft 132*a* at intervals in the order of first shaft gear 132*d*, second shaft gear 132*e*, and third shaft gear 132*f*, in the direction moving away from the housing 130. These first through third shaft gears 132*d*, 132*e*, 132*f* are first helical gears.

A resupply mechanism drive mechanism 120 comprises a connecting member 131, a second clutch 131*e*, and a transmission gear series 134*a*. Note that an input gear series is disposed at one end of the connecting shaft 131*a*, and if the drive power from the drive motor (not shown) is transmitted to the input gear series 235, the connecting shaft 131*a* can be rotated.

The first clutch 131*d* is disposed on the connecting shaft 131*a*, and is a member for transmitting/disengaging the power from the connecting member 131 to the transmission gear series 134*a*. The second clutch 131*e* comprises a first transmission gear 131*b* and the first transmission gear 131*b* rotates as a result of the second clutch 131*e* being connected (power transmission state=clutch ON).

The transmission gear series 134*a* serves to transmit the drive power from the first transmission gear 131*b* of the connecting member 131 to the shaft member 132, and comprises a plurality of intermeshed gears. The plurality of gears in the transmission gear series 134*a* are mounted juxtaposed in the direction orthogonal to the axial direction of the shaft member 132. The output side gear of the transmission gear series 134*a* meshes with a shaft rotating gear 132*c* on the shaft member 132. This shaft rotating gear 132*c* is formed so as to be elongated in the axial direction, so that, when the shaft member 132 moves in the axial direction, it is always meshed with the output side gear of the transmission gear series 134*a*.

The shaft drive mechanism 121 comprises the connecting shaft 131*a*, a second transmission gear 131*c*, the first clutch 131*d*, the rack 135 on the shaft member 132, a transmission shaft member 133, and a friction member (brake means) 133*d*.

The first clutch 131*d* is a member serving to transmit/disengage the drive power of the connecting member 131 to the transmission shaft member 133, and is disposed on the connecting member 131. The first clutch 131*d* is mounted on the second transmission gear 131*c*. Thus, by connecting the first clutch 131*d* (power transmission state=clutch ON), the second transmission gear 131*c* is rotated.

A transmission shaft member comprises a third transmission gear 133*a* and a worm gear 133*c*. The third transmission gear 133*a* is a gear that meshes with the second transmission gear 131*c*, and is a member that is mounted on the one end of the transmission gear shaft 133*b*. The third transmission gear 133*a* rotates in accordance with the rotation of the second transmission gear 131*c* so as to rotate the transmission gear shaft. The transmission gear shaft 133*b* is disposed parallel to the shaft 132*a* of the connecting member 131, and is a member that is shorter than the shaft 132*a* of the connecting member 131. The worm gear 133*c* is a member that is disposed on the end of the side of transmission gear shaft 133*b* at which the third transmission gear 133*a* is not disposed, and meshes with the teeth 135*c* of the rack 135. Consequently, if the worm gear 133*c* that is meshed with the teeth 135*c* of the rack 135 rotates, the rack 135 can move the shaft member 132 in the axial direction, in conjunction with the rotation of the worm gear 133*c*. Furthermore, when any one of the first through third shaft gears 132*d*, 132*e*, 132*f* meshes with any one of the first member rotating gears 151Y, M, C, B and rotates, even if thrust force is generated in the shaft 132*a*, because the teeth 135*c* of the rack 135 are meshed with the worm gear 133*c*, the rack 135 does not move in the axial direction of the shaft 132*a* due to the meshing force between the teeth 135*c* of the rack 135 and the worm gear 133*c*.

Figure 15:
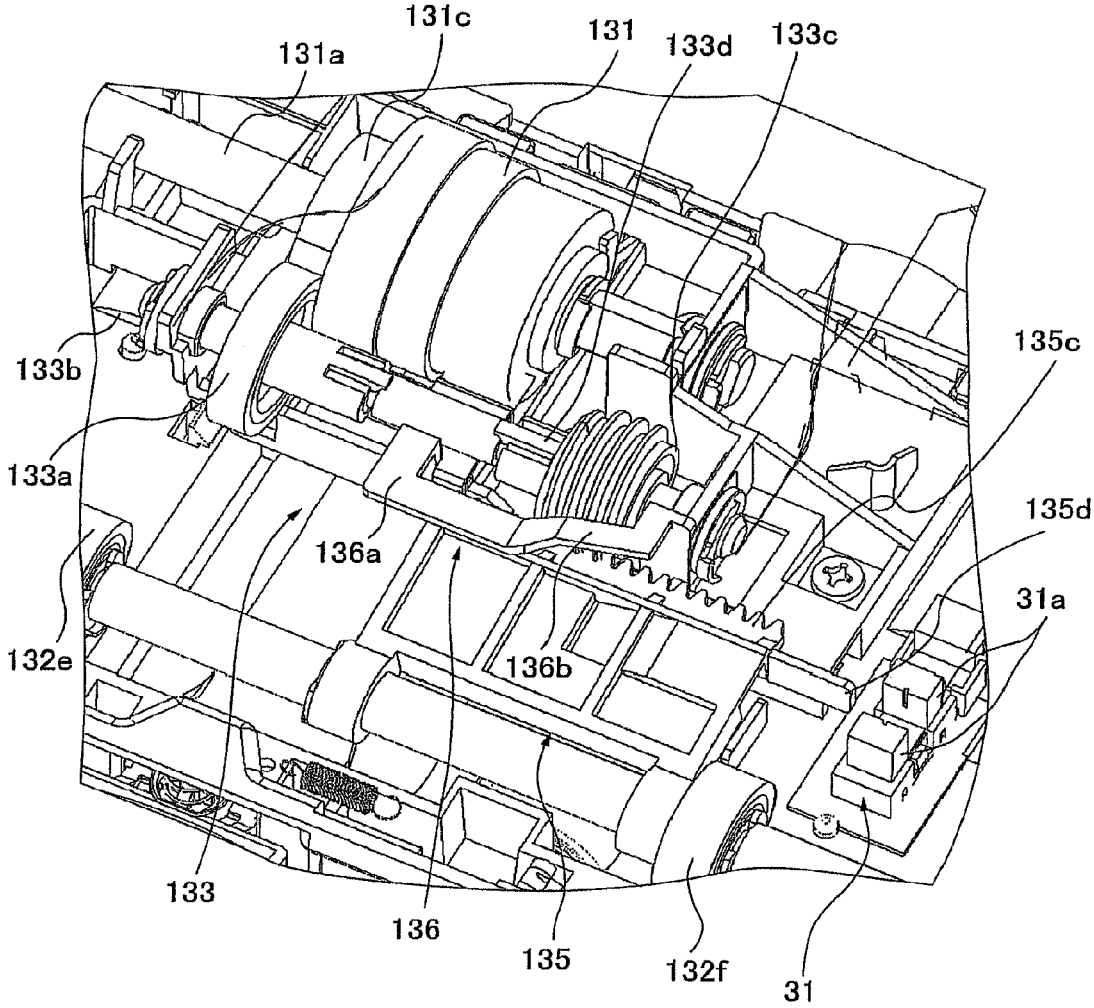
FIG. 15 is an enlarged view of a resupply mechanism drive mechanism and the surroundings thereof.

As shown in FIG. 15, the friction member 133*d* is disposed between the housing 130 and the transmission gear shaft 133*b* so as to bias the transmission gear shaft 133 from the housing 130 side. The friction member 133*d* is an elongate member comprising an elastically deformable high-density microcellular urethane foam (e.g., Poron) and an artificial leather (e.g., Ecsaine) unit. The Poron is fixed in place on the housing 130. The Ecsaine is provided on the face opposite to the housing 130 side, on which the high density microcellular urethane foam is provided, and contacts the transmission gear shaft 133*b*. Thus, by providing the friction member 133*d*, when the second clutch 131*e* is ON and the first clutch 131*d* is OFF, the connecting shaft 131*a* rotates without rotating the second transmission gear 131*c*, but the second transmission gear 131*c* may attempt to rotate due to drag torque, and it is possible to prevent transmission gear shaft 133*b* from rotating by applying frictional force to the transmission gear shaft 133*b* with the friction member 133*d*. Consequently, it is possible to prevent the transmission gear shaft 133*b* from rotating due to the rotation of the transmission gear shaft 133*b*, by way of drag torque, and moving the shaft 132*a*.

With such a drive power transmission mechanism 30, when drive power is transmitted to the connecting shaft 131*a* of the connecting member 131, the drive power is transmitted to the third transmission gear 133*a* by way of the second transmission gear 131*c*. Thereupon, the shaft of the transmission shaft member 133 rotates, the drive power is transmitted to the rack 135 by way of the worm gear 133*c* and the shaft member 132 is moved. At this time, any one of the first through third shaft gears 132*d*, 132*e*, 132*f* meshes with any one of the first member rotating gears 151Y, 151M, 151C, 151B of the output toner transport members 51Y, 51M, 51C, 51B that is to be driven. At this time, the drive power is transmitted from the connecting shaft 131*a* of the connecting member 131 to the shaft rotating gear 132*c*, by way of the transmission gear series 134*a*. When the drive power is transmitted to the shaft rotating gear 132*c*, the shaft 132*a* of the shaft member 132 rotates, and the any one of output toner transport member 51Y, 51M, 51C, 51B can be rotated.

6. Movement Detection Sensor

The movement detection sensor 31 serves to detect the movement of the shaft member 132. The movement detection sensor 31 is mounted on the color printer main body 11 at a predetermined distance from the lateral face of the housing 130 on which the third transmission gear 133*a* is mounted. The movement detection sensor 31 comprises two sensor units 31*a*. The two sensor units 31*a* are disposed facing each other over a predetermined distance. The tip of the protrusion 132*d* on the rack 135 can be interposed and removed from between these two sensor units 31*a*. Here, when the rack 135 on the shaft member 132 is positioned furthest away from the side on which the motor is disposed, which is to say, on the right hand side in FIG. 14, the protrusion 135*d* of the rack 135 is positioned between the two sensor units 31*a*. The situation when the protrusion 135*d* on the rack 135 is positioned between the two sensor units 31*a* is defined as the home position for the shaft member 132. If the shaft member 132 moves from this home position to the left in FIG. 14, the protrusion 135*d* on the rack 135 is removed from between the two sensor units 31*a*. Thus, when the protrusion 135*d* on the rack 135 is removed from between the two sensor units 31*a*, the sensor units 31*a* of the movement detection sensor 31 detect that the shaft member 132 has moved.

Note that the shaft member 132 is normally located in the home position and, from among the first through third shaft gears 132*d*, 132*e*, 132*f*, the third shaft gear 132*f*, which is located on the movement detection sensor 31 side, meshes with the first member rotating gear 151B on the black output toner transport member 51B.

7. Movement Stopping Mechanism

The movement stopping mechanism 32 is a mechanism for limiting the movement of the rack 135 when the rack 135 is moved away from the position of the rack 135 when the shaft member 132 is located in the home position (hereafter referred to as the end position) in the direction in which the movement detection sensor 31 is disposed (to the right in FIG. 14). The movement stopping mechanism 32 comprises the wall 135*k* (see FIG. 17), and a protrusion 130*a* (see FIG. 16) (protrusion). Here, FIG. 16 is a drawing showing the protrusion 130*a*, the rack 135 and the movement detection sensor 31. The protrusion 130*a* is disposed in a position corresponding to the level face 135*n* when the rack 135 is located at the end position, and is provided on the housing 130. Furthermore, the protrusion 130*a* protrudes to a height that is substantially the same as the height of the movement detection sensor 31. With this movement stopping mechanism 32, when the rack 135 moves beyond the end position, first, the protrusion 130*a* contacts the wall 135*k*. At this time, the inclination 135*m* is gradually lifted by the protrusion 130*a* in accordance with the movement of the rack 135.

This is to say, the rack 135 turns around the shaft 132*a*. Here, the protrusion 130*a* contacts the left end in FIG. 17 of the inclination 135*m* before the end of the planar unit 135*b* of the rack 135 that is closest to the location at which the movement detection sensor 31 is disposed (the right side in FIG. 14) touches the movement detection sensor 31. At this time, the meshing of the teeth 135*c* and the worm gear 133*c* is disengaged so as to limit the movement of the rack 135. Note that the movement detection sensor 31 is located within the groove 135*e*. Consequently, it is possible to prevent the movement detection sensor 31 from touching the rack 135, and thus prevent damage to the movement detection sensor 31.

Furthermore, a support member 136 for the rack 135 is provided on the housing 130, which supports the rack 135 so that the rack 135 does not turn when the rack 135 moves further to the left in FIG. 14 than the end position. This support member 136 comprises a first support unit 136*a*, which supports the rack 135 when the rack 135 moves further to the left in FIG. 14 than the end position, and a second support unit 136*b*, which is disposed parallel to the inclination 135*k*, from the right end of the first support unit 136*a* in FIG. 14, so as not to impede the turning of the planar unit 135*b*.

8. Control Unit

The control unit controls the drive motor, the second clutch 131*e* and the first clutch 131*d*. This control unit controls the amount of movement of the shaft member 132 and the amount of rotation of the shaft member 132 by way of the drive power transmission mechanism 30, and switches the second clutch 131*e* and the first clutch 131*d* ON and OFF. If the second clutch 131*e* is turned OFF and the first clutch 131*d* is turned ON, the second transmission gear 131*c* is rotated in accordance with the rotation of the connecting member 131, and the third transmission gear 133*a* rotates together with the second transmission gear 131*c*. Then, the transmission gear shaft 133*b* and the worm gear 133*c* are rotated by the rotation of the third transmission gear 133*a*. The drive power of the worm gear 133*c* is transmitted to the rack 132*b*, so as to move the shaft member 132. Then, if the first clutch 131*d* is turned OFF and the second clutch 131*e* is turned ON, the first transmission gear 131*b* is rotated in accordance with the rotation of the connecting member 131, and the transmission gear series 134*a* is driven. Thus, the drive power is transmitted from the transmission gear series 134*a* to the shaft rotating gear 132*c*, and the shaft member 132 rotates.

For example, if black toner is to be transported, because the shaft member 132 is normally in the home position, the control unit sets the second clutch 131*e* to ON and the sets the first clutch 131*d* to OFF, so that the shaft member 132, which is to say, the third shaft gear 132*f*, which has meshed with the first member rotating gear 151B of the black output toner transport member 51B, is rotated by a predetermined amount.

For example, if yellow toner is to be transported, the control unit sets the second clutch 131*e* to OFF and the first clutch 131*d* to ON, and moves the shaft member 132 by a predetermined amount, so as to mesh the first shaft gear 132*d* on the shaft member 132 with the first member rotating gear 151Y of the yellow output toner transport member 51Y. Then, the control unit sets the second clutch 131*e* to ON and the first clutch 131*d* to OFF, and rotates the first shaft gear 132*d* on the shaft member 132, which is meshed with the first member rotating gear 151Y of the yellow output toner transport member 51Y, by a predetermined amount.

For example, if magenta toner is to be transported, the control unit sets the second clutch 131*e* to OFF and the first clutch 131*e* to ON and moves the shaft member 132 by a predetermined amount, so as to mesh the second shaft gear 132*e* on the shaft member 132 with the first member rotating gear 151M of the magenta output toner transport member 51M. Then, the control unit sets the second clutch 131*e* to ON and the first clutch 131*d* to OFF, and rotates the second shaft gear 132*e* on the shaft member 132, which is meshed with the first member rotating gear 151M of the magenta output toner transport member 51M, by a predetermined amount.

For example, if cyan toner is to be transported, the control unit sets the second clutch 131*e* to OFF and the first clutch 131*d* to ON, and moves the shaft member 132 by a predetermined amount, so as to mesh the third shaft gear 132*f* on the shaft member 132 with the first member rotating gear 151C of the cyan output toner transport member 51C. Then, the control unit sets the second clutch 131*e* to ON and the first clutch 131*d* to OFF, and rotates the third shaft gear 132*f* on the shaft member 132, which is meshed with the first member rotating gear 151C of the cyan output toner transport member 51C, by a predetermined amount.

Thus, by moving the shaft member 132 and rotating the shaft gears 132*d*, 132*f*, 132*e* on the mobile member by predetermined amounts, the first member rotating gears 151Y, 151M, 151C, 151B, which are meshed with the shaft gears 132*d*, 132*f*, 132*e*, are rotated. Thereupon, the output toner transport members 51Y, 51M, 51C, 51B are rotated and the various colors of toner are transported to the first output units 52Y, 52M, 52C, 52B.

Furthermore, if the output toner transport members 51Y, 51M, 51C, 51B are rotated, the container coupling gears 88Y, 88M, 88C, 88B, which are connected to the coupling gears 152Y, 152M, 152C, 152B of the output toner transport members 51Y, 51M, 51C, 51B, rotate, and the first intermediate gears 86Y, 86M, 86C, 86B rotate. Thereupon, the second intermediate gear 87B and the second member rotating gears 182Y, 182M, 182C, 182B, which are meshed with the first intermediate gears 86Y, 86M, 86C, 86B, rotate. Then, the toner stirring members 81Y, 81M, 81C, 81B, which correspond to the third member rotating gear 181B, which is meshed with the second intermediate gear 87B, and the third member rotating gears 181Y, 181M, 181C, which are meshed with the first intermediate gears 86Y, 86M, 86C, as well as the toner transport members 82Y, 82M, 82C, 82B, which correspond to the second member rotating gears 182Y, 182M, 182C, 182B, rotate.

Consequently, the toner that is held in the toner container main bodies 8Ya, 8Ma, 8Ca, 8Ba is stirred and transported towards the second output units 80Yc, 80Mc, 80Cc, 80Bc.

Thus, by meshing the shaft gears 132*d*, 132*f*, 132*e* on the mobile member with the first member rotating gears 151Y, 151M, 151C, 151B and rotating, it is possible to rotate the toner stirring members 81Y, 81M, 81C, 81B, the output toner transport members 51Y, 51M, 51C, 51B, and the toner transport members 82Y, 82M, 82C, 82B, so as to transport the various toners from the toner container main bodies 8Ya, 8Ma, 8Ca, 8Ba to the toner transport units 80Yb, 80Mb, 80Cb, 80Bb to be transported in the direction of the first output units 52Y, 52M, 52C, 52B, in the toner transport units 80Yb, 80Mb, 80Cb, 80Bb.

Note that, after transporting the various colors of toner, the control unit sets the second clutch 131*e* to OFF and the first clutch 131*d* to ON and returns the shaft member 132 to the home position.

Meanwhile, if the various colors of toner are to be continuously transported, first the control unit sets the second clutch 131*e* to OFF and sets the first clutch 131*d* to ON and rotates the shaft member 132, which is in the home position, which is to say, the first shaft gear 132*d*, which is meshed with first member rotating gear 151B of the black output toner transport member 51B, by a predetermined amount.

Next, the control unit sets the second clutch 131*e* to OFF and the first clutch 131*d* to ON, and moves the shaft member 132 by a predetermined amount so as to mesh the third shaft gear 132*f* on the shaft member 132 with the first member rotating gear 151Y of the yellow output toner transport member 51Y. Then, the control unit sets the second clutch 131*e* to ON and the first clutch 131*d* to OFF, and rotates the first shaft gear 132*d* on the shaft member 132, which is meshed with the first member rotating gear 151Y of the yellow output toner transport member 51Y, by a predetermined amount.

Then, the control unit sets the second clutch 131*e* to OFF and the first clutch 131*d* to ON, and moves the shaft member 132 by a predetermined amount so as to mesh the second shaft gear 132*e* on the shaft member 132 with the first member rotating gear 151M of the magenta output toner transport member 51M. Then, the control unit sets the second clutch 131*e* to ON and the first clutch 131*d* to OFF, and rotates the second shaft gear 132*e* on the shaft member 132, which is meshed with the first member rotating gear 151Y of the magenta output toner transport member 51M, by a predetermined amount.

Lastly, the control unit sets the second clutch 131*e* to OFF and the first clutch 131*d* to ON, and moves the shaft member 132 by a predetermined amount so as to mesh the first shaft gear 132*d* on the shaft member 132 with the first member rotating gear 151C of the cyan output toner transport member 51C. Then, the control unit sets the second clutch 131*e* to ON and the first clutch 131*d* to OFF, and rotates the third shaft gear 132*f* on the shaft member 132, which is meshed with the first member rotating gear 151C of the cyan output toner transport member 51C, by a predetermined amount.

If the shaft member 132 is incrementally moved in this manner and the shaft gears 132*d*, 132*f*, 132*e* on the mobile member are rotated by predetermined amounts, the first member rotating gears 151Y, 151M, 151C, 151B, which are meshed with the shaft gears 132*d*, 132*f*, 132*e*, are rotated. Thereupon, the output toner transport members 51Y, 51M, 51C, 51B are rotated and the various colors of toner are transported to the first output units 52Y, 52M, 52C, 52B. Furthermore, if the output toner transport members 51Y, 51M, 51C, 51B are rotated, the container coupling gears 88Y, 88M, 88C, 88B, which are connected to the coupling gears 152Y, 152M, 152C, 152B of the output toner transport members 51Y, 51M, 51C, 51B, rotate, and the first intermediate gears 86Y, 86M, 86C, 86B rotate. Thereupon, the second intermediate gears 87Y, 87M, 87C, 87B and the second member rotating gears 182Y, 182M, 182C, 182B, which are meshed with the first intermediate gears 86Y, 86M, 86C, 86B, rotate, and the toner stirring members 81Y, 81M, 81C, 81B, which comprise the third member rotating gears 181Y, 181M, 181C, 181B that are meshed with the second intermediate gears 87Y, 87M, 87C, 87B, and the toner transport members 82Y, 82M, 86C, 86B, which comprise the second member rotating gears 182Y, 182M, 182C, 182B, rotate. Consequently, the toner that is held in the toner container main bodies 8Ya, 8Ma, 8Ca, 8Ba is stirred and transported towards the second output units 80Yc, 80Mc, 80Cc, 80Bc.

Thus, by successively meshing the shaft gears 132*d*, 132*f*, 132*e* on the mobile member with the first member rotating gears 151Y, 151M, 151C, 151B and rotating, it is possible to rotate the toner stirring members 81Y, 81M, 81C, 81B, the output toner transport members 51Y, 51M, 51C, 51B, and the toner transport members 82Y, 82M, 82C, 82B, so as to transport the various toners from the toner container main bodies 8Ya, 8Ma, 8Ca, 8Ba to the toner transport units 80Yb, 80Mb, 80Cb, 80Bb to be transported in the direction of the first output units 52Y, 52M, 52C, 52B in the toner transport units 80Yb, 80Mb, 80Cb, 80Bb.

Note that after continuously transporting the various colors of toner, the control unit sets the second clutch 131*e* to ON and the first clutch 131*d* to OFF, and returns the shaft member 132 to the home position. Then, if the shaft member 132 moves further in the direction of the movement detection sensor 31 than the home position as a result of a fault in the movement detection sensor 31 or the like, which is to say, if the rack 135 moves further to the right in FIG. 14 than the end position, the protrusion 130*a* contacts the inclination 135*m* of the wall 135*k* on the rack 135, so that the rack 135 is gradually turned around the connecting unit 135*a* in accordance with the movement of the rack 135. Because the rack 135 is moved by the protrusion 130*a* before the rack 135 collides with the movement detection sensor 31, it is possible to prevent damage to the movement detection sensor 31 by turning this rack 135. At this time, the meshing of the teeth 135*c* on the rack 135 and the worm gear 133*c* is disengaged. Consequently, it is possible to cut off the drive power to the rack 135 and thus limit the movement of the rack 135. Thus, by turning the rack 135, it is possible to avoid letting the rack touch the movement detection sensor 31.

Furthermore, if the second clutch 131*e* is set to OFF and the first clutch 131*d* is set to ON, the connecting shaft 131*a* rotates without the second transmission gear 131*c* rotating, but the second transmission gear 131*c* may attempt to rotate as a result of drag torque. However, if the transmission gear shaft 133*b* attempts to rotate, the transmission gear shaft 133*b* is prevented from rotating by the friction member 133*d*, as a result of the frictional force that acts on the transmission gear shaft 133*b*. Consequently, it is possible to prevent the second transmission gear 131*c* from rotating the transmission gear shaft 133*b* by way of drag torque, and moving the shaft 132*a*. In other words, control of the movement of the shaft member 132 is facilitated. Furthermore, it is possible to prevent the shaft member 132 from moving, and the mobile member shaft gears 32*d*, 132*f*, 132*e* from rotating the first member rotating gears 151Y, 151M, 151C, 151B, so that resupply of colors of toner for which resupply is not needed can be prevented.

9. Toner Resupply Pipes

A plurality of toner resupply pipes 13, for example, four toner resupply pipes 13, comprise toner resupply tubes 13*a*. Each of the four toner resupply pipes 13 are connected to the corresponding first output units 52Y, 52M, 52C, 52B, by way of one of the toner resupply tubes 13*a*. These four toner resupply pipes 13 are juxtaposed in the direction of the rotary shaft 41 of the rotary development device 4, between the toner container 8 and the rotary development device 4. Furthermore, the four toner resupply pipes 13 are disposed between the laser unit 12 and the photosensitive drum 1.

The four toner resupply pipes 13Y, 13M, 13C, 13B resupply the various colors of toner to the rotary development device 4, by insertion into the rotary development device 4, at predetermined rotational positions of the rotary development device 4. For example, the toner resupply pipe 13Y that is mounted on the first output unit 52Y, by way of the toner resupply tube 13*a*, resupplies yellow toner to a yellow developer 4Y of the rotary development device 4, as described hereafter. The toner resupply pipe 13M that is mounted on the first output unit 52M, by way of the toner resupply tube 13*a*, resupplies magenta toner to a magenta developer 4M of the rotary development device 4, as described hereafter. The toner resupply pipe 13C that is mounted on the first output unit 52C, by way of the toner resupply tube 13*a*, resupplies cyan toner to a cyan developer 4C of the rotary development device 4, as described hereafter. The toner resupply pipe 13B that is mounted on the first output unit 52B, by way of the toner resupply tube 13*a*, resupplies black toner to a black developer 4B of the rotary development device 4, as described hereafter.

The rotary development device 4 is a device for supplying toner to the surface of the photosensitive drum 1, on which an electrostatic latent image has been formed, so as to form a toner image on the photosensitive drum 1. The rotary development device 4 is rotatably mounted within the color printer main body 11. This rotary development device 4 comprises a rotary rack 40 and the plurality of developers 4Y, 4M, 4C, 4B.

The rotary rack 40 comprises the rotary shaft 41 and is rotatably mounted on the color printer main body 11 by way of this rotary shaft 41. While rotating around the rotary shaft 41, as a result of rotation means not shown in the drawing, the rotary rack 40 successively displaces the plurality of developers 4Y, 4M, 4C, 4B to developing positions facing the photosensitive drum 1.

The four developers 4Y, 4M, 4C, 4B are adjacently disposed around the rotary shaft 41, and supported by the rotary rack 40. Here, the yellow developer 4Y, the magenta developer 4M, the cyan developer 4C and the black developer 4B are disposed one after another in the circumferential direction around the rotary rack 40, which is to say, around the rotary shaft 41, in the 4Y, 4M, 4C, 4B order, and supported by the rotary rack 40. These four developers 4Y, 4M, 4C, 4B are disposed at intervals of approximately 90 degrees in the circumferential direction.

As shown in FIG. 9, each of the four developers 4Y, 4M, 4C, 4B comprise a developer main body 4*a*, a developer toner stirring member 4*b*, a developer roller 4*c*, and a toner supply roller 4*d*.

The developer toner stirring member 4*b* serves to stir the toner that is held inside the developer main body 4*a*, and is rotatably mounted within the developer main body 4*a*. Here, the developer toner stirring member 4*b* is rotatably mounted within the developer main body 4*a*, on the side that is distant from the photosensitive drum 1 and the developer roller 4*c*, which is to say, on the side of the rotary shaft 41 of the rotary rack 40.

The developer roller 4*c* serves to affix the toner that is held in the developer main body 4*a* on the electrostatic latent image on the surface of the photosensitive drum 1. The developer roller 4*c* comprises a rotary shaft and is rotatably mounted within the developer main body 4*a* by way of this rotary shaft. Here, the developer roller 4*c* is rotatably mounted within the developer main body 4*a*, at the side of the external peripheral face of the rotary rack 40.

The toner supply roller 4*d* serves to supply toner from the developer toner stirring member 4*b* side to the developer roller 4*c* side, and is rotatably mounted within the developer main body 4*a*, between the developer toner stirring member 4*b* and the developer roller 4*c*.

As described above, in the color printer 100, by moving the shaft member 132 in the axial direction, and after moving the shaft member 132, rotating the shaft member 132, it is possible to transmit the drive power of the drive motor to the output toner transport members 51Y, 51M, 51C, 51B, with one drive power transmission mechanism 30. Consequently, it is not necessary to provide a plurality of drive motors, which allows for a reduction in the size of the drive power transmission mechanism 30, and a reduction in the manufacturing costs of the drive power transmission mechanism 30. Furthermore, because housing 130 of the drive power transmission mechanism 30 is mounted on the color printer main body 11 so that the shaft member 132 of the drive power transmission mechanism 30 crosses the rotary shafts of the output toner transport members 51Y, 51M, 51C, 51B, by disposing the drive power transmission mechanism 30 in juxtaposition with a plurality of toner container main bodies 8Ya, 8Ma, 8Ca, 8Ba, it is possible to reduce the dimensions of the color printer main body 11 in one direction (the direction orthogonal to the direction in which the containers are aligned).

In other words, it is possible to reduce the size of the color printer 100.

Furthermore, the teeth 135*c* on the rack 135 of the shaft member 132, which mesh with the worm gear 133*c* of the shaft member drive mechanism (first transmission mechanism) move the shaft member 132 in the axial direction in conjunction with the rotation of the worm gear 133*c*. At this time, it is possible to precisely displace the shaft member 132 in the axial direction while reliably meshing the worm gear 133*c* and the rack 135, by way of the thrust force generated in the direction of the rotary shaft of the worm gear 133*c*.

Next, the movement detection sensor detects the movement of the shaft member 132, and the amount of movement and the amount of rotation of the shaft member 132 are controlled by the control unit, whereby it is possible to precisely move the shaft member 132 in the axial direction and to rotate it.

Next, when the shaft member 132 is moved in the axial direction, any one of the plurality of shaft gears 132*d*, 132*e*, 132*f* meshes with the first member rotating gears 151Y, 151M, 151C, 151B of the output toner transport members 51Y, 51M, 51C, 51B that is to be driven, whereby the drive power can be individually transmitted to the output toner transport members 51Y, 51M, 51C, 51B.

Next, the shaft gears 132*d*, 132*e*, 132*f* are first helical gears and the first member rotating gears 151Y, 151M, 151C, 151B are second helical gears, whereby, even though the shaft member 132 crosses the rotary shaft of the output toner transport members 51Y, 51M, 51C, 51B, it is possible to reliably transmit the drive power from the shaft member 132 to the output toner transport members 51Y, 51M, 51C, 51B.

Lastly, the black output toner transport member 51B and the output unit 52B are disposed on the cyan container main body 8Ca side. Consequently, the axial separation between the black output toner transport member 51B and the cyan output toner transport member 51C can be shortened. Consequently, a single shaft gear 132*f* suffices for the meshing gears between the first member rotating gear 151B of the black output toner transport member 151B and the first member rotating gear 151C of the cyan output toner transport member 51C. In other words, it is possible to rotate the output toner transport members 51Y, 51M, 51C, 51B without providing four shaft gears on the shaft 132*a* of the shaft member 132, but only providing three shaft gears 132*d*, 132*e*, 132*f*. Furthermore, by disposing the black output toner transport member 51B and the output unit 52B on the cyan container main body 8Ca side, even if the black container main body 8Ba has a large volume, the length of the toner supply route for the toner resupply member for supplying toner to the black developer 4B from the black container main body 8Ba can be kept short. In addition, the second shutter opening/closing mechanism 85B of the black container main body 8Ba comprises the third engagement gear 385B that meshes between the second operating member 185B and the second engagement gear 285B, whereby it is possible to make the direction of turning of the second operating member 185B the same as that of the first operating members 185Y, 185M, 185C of the first shutter opening/closing mechanisms 85Y, 85M, 85C, of the other container main bodies 8Ya, 8Ma, 8Ca. In other words, it is possible for the direction of turn, which is to say, the direction of operation, of the operating members 185Y, 185M, 185C, 185B of the container main bodies 8Ya, 8Ma, 8Ca, 8Ba to be the same.

Note that the toner resupply mechanisms comprise the toner resupply pipes 13, the toner resupply tubes 13*a*, the first member rotating gears 151Y, 151M, 151C, 151B, the output toner transport members 51Y, 51M, 51C, 51B, the coupling gears 152Y, 152M, 152C, 152B, the container coupling gears 88Y, 88M, 88C, 88B, the first intermediate gears 86Y, 86M, 86C, 86B, the second intermediate gears 87Y, 87M, 87C, 87B, the third member rotating gears 181Y, 181M, 181C, 181B, the second member rotating gears 182Y, 182M, 182C, 182B, the toner transport members 82Y, 82M, 82C, 82B, the first shutter opening/closing mechanisms 85Y, 85M, 85C, and the second shutter opening/closing mechanism 85B.

Other Embodiments (a) The present invention can be applied to image forming devices such as copiers, printers and fax machines, which have a color printing function.

(b) In the modes of embodiment described above, examples were illustrated wherein three shaft gears 132*d*, 132*e*, 132*f* were mounted on the shaft 132*a*, but the number of shaft gears is not limited to the embodiments described above, and four shaft gears may be used.

(c) In the embodiments described above, an example was illustrated wherein the color printer 100 comprised a transport toner holding unit 50. However, if the color printer 100 does not comprise a transport toner holding unit 50, it is possible to transmit drive power to the toner container 8 by meshing the shaft gears of the shaft member with the second member rotating gears 182Y, 182M, 182C, 182B of the toner transport members 82Y, 82M, 82C, 82B, and rotating the toner transport members 82Y, 82M, 82C, 82B. In other words, the toner transport members 82Y, 82M, 82C, 82B play the role of the output toner transport members in the embodiments described above. Furthermore, the toner transport members 82Y, 82M, 82C, 82B may also be rotated by meshing the shaft rotating gear of the shaft member with at least one idling gear, and meshing this idling gear with the second member rotating gears 182Y, 182M, 182C, 182B of the toner transport members 82Y, 82M, 82C, 82B. In this case also, the drive power can be transmitted to the toner container 8.

(d) In the embodiment described above, an example was illustrated wherein the friction member 133*d* comprised a high-density microcellular urethane foam and Ecsaine, but the present invention is not limited to this, and the friction member 133*d* may be formed from other substances (for example, elastic materials such as urethane foam or rubber and nonwoven fabrics or the like).

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Moreover, terms that are expressed as "means-plus function" in the claims should include any structure that can be utilized to carry out the function of that part of the present invention. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming device comprising:

an image forming device main body;

an image bearing member rotatably mounted on the image forming device main body;

a development device configured to supply toner to a surface of the image bearing member;

a plurality of toner holding containers mounted in juxtaposition on the image forming device main body, each toner holding container comprising a toner holding container main body, a toner transport member rotatably mounted within the toner holding container main body and configured to transport the toner; and a drive power transmission mechanism comprising a housing mounted on the image forming device main body, a shaft member mounted on the housing so as to be axially rotatable and movable in the axial direction, a first transmission mechanism mounted on the housing and configured to transmit a drive power of a drive means to the shaft member so that the shaft member moves in the axial direction, and a second transmission mechanism mounted on the housing configured to transmit the drive power of the drive means to the shaft member so that the shaft member is rotated, and the toner transport member that is to be driven being rotated by moving the shaft member in the axial direction with the drive power that is transmitted to the shaft member by the first transmission mechanism, and rotating the shaft member with the drive power that is transmitted to the shaft member by the second transmission mechanism.

2. The image forming device recited in claim 1, wherein the shaft member comprises a plurality of first gears arranged at intervals in the axial direction of the shaft member and non-rotatably mounted on the shaft member, the toner transport member comprises a second gear non-rotatably mounted on a rotary shaft, and when the shaft member has been moved in the axial direction by the first transmission mechanism, any one of the plurality of first gears meshes with the second gear of the toner transport member that is to be driven.

3. The image forming device recited in claim 2, wherein either one of the first gears or the second gear is a helical gear, and the other of the first gears and the second gear mesh with the helical gear.

4. The image forming device recited in claim 2, further comprising a detection unit configured to detect an initial position of the shaft member at an edge of a range of movement, wherein the first transmission mechanism moves the shaft member from the initial position by a distance corresponding to a position to mesh with an input gear.

5. The image forming device recited in claim 1, further comprising a toner resupply member arranged between the toner holding container and the development device and configured to resupply toner to the development device, wherein the toner transport member and an output unit configured to output the toner that has been transported by the toner transport member to the toner resupply member on at least one of the toner holding container main bodies that are disposed at the two ends of a row of the plurality of juxtaposed toner holding container main bodies are disposed on the adjacent toner holding container main body side.

6. The image forming device recited in claim 1, wherein the plurality of toner holding containers each further comprises a shutter member configured to cut off external output of the toner that is held in the toner holding container main body mounted on the toner holding container main body, and a shutter opening/closing mechanism mounted on the toner holding container main body so that the shutter member is configured to assume an open position and a toner blocking position, the shutter opening/closing mechanism on a toner holding container main body other than the at least one of the toner holding container main bodies that are disposed at the two ends of the row of the plurality of juxtaposed toner holding container main bodies comprises an operating member configured to operate so as to position the shutter member that is rotatably mounted on the toner holding container main body in the open position and the toner blocking position, and a first gear that engages with the operating member that is mounted on the shutter member; and the shutter opening/closing mechanism of at least one of either of the toner holding container main bodies that are disposed at the two ends of the row of the plurality of juxtaposed toner holding container main bodies comprises the operating member, a second gear mounted on the shutter member, and a fifth third gear mounted on the toner holding container main body between the operating member and the second gear and configured to engage with the operating member and the second gear.

7. The image forming device recited in claim 1, further comprising a movement stopping mechanism configured to stop the operation of the first transmission mechanism if the shaft member has moved beyond a predetermined range of movement.

8. The image forming device recited in claim 7 wherein the shaft member comprises a rack arranged on the shaft member, the rack configured to move together with the shaft member, the first transmission mechanism comprises a worm gear configured to mesh with the rack, and the movement stopping mechanism is configured to disengage the meshing of the rack and the worm gear.

9. The image forming device recited in claim 8, wherein
the rack is mounted so as to be axially rotatable around the shaft member,
the movement stopping mechanism comprises
a projection which is fixed in place so as to be non-movable with respect to the rack, and
a striking unit having an inclined face and arranged on the rack to strike the projection, and
the rack axially rotates around the shaft member as a result of the striking unit striking the projection, and disengage the meshing of the rack and the worm gear, when the rack moves beyond the range of movement together with the shaft member.

10. The image forming device recited in claim 9 further comprising a detection unit configured to detect an initial position of the shaft member at an edge of the range of movement, wherein the rack is prevented from coming into contact with the detection unit by turning the rack when the rack moves beyond the range of movement together with the shaft member.

11. The image forming device recited in claim 8, further comprising a support member configured to support the rack so that the rack and the worm gear remain meshed while the shaft member moves within a predetermined range of movement, and to support the rack so that, when the shaft member moves beyond the predetermined range of movement, the meshing between the rack and the worm gear is disengagable.

12. The image forming device recited in claim 1, wherein
the first transmission mechanism comprises a first clutch configured to transmit/disengage the power for moving the shaft member, and a brake unit configured to restrict movement of the shaft member as a result of drag torque when the first clutch is in a power disengagement state.

13. The image forming device recited in claim 12, wherein
the shaft member comprises a rack arranged on the shaft member, the rack configured to move together with the shaft member,
the first transmission mechanism comprises a worm gear configured to mesh with the rack, and
the brake unit is a friction member configured to restrict the rotation of the worm gear.

14. The image forming device recited in claim 1, wherein the second transmission mechanism further comprises a second clutch configured to transmit/disengage the power to rotate the shaft member.

15. The image forming device recited in claim 1, wherein drive power is supplied to the first transmission mechanism and the second transmission mechanism from the same drive source.

16. The image forming device recited in claim 1, wherein the housing of the drive power transmission mechanism is mounted on the image forming device main body so that the shaft member of the drive power transmission mechanism crosses the rotary shaft of the toner transport member.

17. The image forming device recited in claim 1, wherein the toner holding container comprising
the toner holding container main body,
a toner stirring member rotatably mounted within the toner holding container main body and configured to stir toner that is held in the toner holding container main body, and
the toner transport member configured to transport that has been stirred by the toner stirring member.

18. An image forming device comprising:
an image forming device main body;
an image bearing member rotatably mounted on the image forming device main body;
a development device configured to supply toner to a surface of the image bearing member;
a plurality of toner holding containers mounted in juxtaposition on the image forming device main body, each toner holding container comprising
a toner holding container main body, and
a toner transport member rotatably mounted within the toner holding container main body and configured to transport the toner; and
a transported toner holding unit arranged in the vicinity of the toner holding container main bodies, the transported toner holding unit comprising
a transported toner holding unit main body and configured to hold toner that has been transported by the toner transport member, and
an output toner transport member rotatably mounted within the transported toner holding unit main body on a rotary shaft of the output toner transport member and configured to transport toner that is held in the transported toner holding unit main body and output this toner from the transported toner holding unit main body; and
a drive power transmission mechanism comprising
a housing mounted on the image forming device main body,
a shaft member mounted on the housing so as to be axially rotatable and movable in the axial direction,
a first transmission mechanism mounted on the housing and configured to transmit a drive power of a drive means to the shaft member so that the shaft member moves in the axial direction, and
a second transmission mechanism mounted on the housing configured to transmit the drive power of the drive means to the shaft member so that the shaft member is rotated,
the housing of the drive power transmission mechanism being mounted on the image forming device main body, and
at least any one of the toner transport member and the output toner transport member that is to be driven being rotated by moving the shaft member in the axial direction with the drive power that is transmitted to the shaft member by the first transmission mechanism, and rotating the shaft member with the drive power that is transmitted to the shaft member by the second transmission mechanism.

19. The image forming device recited in claim 18, wherein the toner transport member includes a rotary shaft that is rotatably mounted within the toner holding container main body, the housing of the drive power transmission mechanism is mounted on the image forming device main body so that the shaft member of the drive power transmission mechanism crosses at least any one of the rotary shaft of the toner transport member and the rotary shaft of the output toner transport member.

20. The image forming device recited in claim 18, wherein the shaft member comprises
a plurality of first gears arranged at intervals in the axial direction of the shaft member and non-rotatably mounted on the shaft member,
the output toner transport member comprises a second gear non-rotatably mounted on the rotary shaft member, and
when the shaft member has been moved in the axial direction by the first transmission mechanism, any one of the plurality of first gears meshes with the second gear of the output toner transport member that is to be driven.

21. The image forming device recited in claim 20, wherein either one of the first gears or the second gear is a helical gear, and the other of the first gears and the second gear is configured to mesh with the helical gear.

22. The image forming device recited in claim 20, further comprising a detection unit configured to detect an initial position of the shaft member at an edge of a range of movement, and wherein the first transmission mechanism moves the shaft member from the initial position by a distance corresponding to a position to mesh with an input gear.

23. The image forming device recited in claim 18, further comprising a toner resupply member arranged between the toner holding container and the development device and configured to resupply toner to the development device, wherein the output toner transport member and an output unit configured to output the toner that has been transported by the output toner transport member to the toner resupply member on at least one of the toner holding container main bodies that are disposed at the two ends of a row of the plurality of juxtaposed toner holding container main bodies are disposed on the adjacent toner holding container main body side.

24. An image forming device comprising:

an image forming device main body;

an image bearing member rotatably mounted on the image forming device main body;

a development device configured to supply toner to a surface of the image bearing member;

a plurality of toner holding containers mounted in juxtaposition on the image forming device main body, each toner holding container comprising a toner holding container main body, a toner stirring member rotatably mounted within the toner holding container main body and configured to stir toner that is held in the toner holding container main body, and a toner transport member rotatably mounted within the toner holding container main body and configured to transport the toner having been stirred by the toner stirring member;

a transported toner holding unit arranged in the vicinity of the toner holding container main bodies, the transported toner holding unit comprising a transported toner holding unit main body and configured to hold toner that has been transported by the toner transport member, and an output toner transport member rotatably mounted within the transported toner holding unit main body on a rotary shaft and configured to transport toner held in the transported toner holding unit main body and to output this toner from the transported toner holding unit main body; and a drive power transmission mechanism comprising a housing mounted on the image forming device main body, a shaft member mounted on the housing so as to be axially rotatable and movable in the axial direction, a first transmission mechanism mounted on the housing and configured to transmit a drive power of a drive means to the shaft member so that the shaft member moves in the axial direction, and a second transmission mechanism mounted on the housing configured to transmit the drive power of the drive means to the shaft member so that the shaft member is rotated, the housing of the drive power transmission mechanism being mounted on the image forming device main body so that the shaft member of the drive power transmission mechanism crosses the rotary shaft of the output toner transport member, and the output toner transport member that is to be driven being rotated by moving the shaft member in the axial direction with the drive power that is transmitted to the shaft member by the first transmission mechanism, and rotating the shaft member with the drive power that is transmitted to the shaft member by the second transmission mechanism.

* * * * *